US007360806B2

(12) United States Patent
Ching

(10) Patent No.: US 7,360,806 B2
(45) **Date of Patent: *Apr. 22, 2008**

(54) METHODS AND APPARATUS FOR FACILITATING SECURITY AND TAMPER CONTROL

(76) Inventor: Henry Kong Sun Ching, 220 Riverside Blvd., Apt. 27C, New York, NY (US) 10069

( * ) Notice: Subject to any disclaimer, the term of this patent is extended or adjusted under 35 U.S.C. 154(b) by 110 days.

This patent is subject to a terminal disclaimer.

(21) Appl. No.: 10/964,947

(22) Filed: Oct. 14, 2004

(65) Prior Publication Data

US 2005/0156438 A1 Jul. 21, 2005

Related U.S. Application Data

(63) Continuation-in-part of application No. 10/896,216, filed on Jul. 21, 2004, now Pat. No. 7,264,287.

(60) Provisional application No. 60/568,619, filed on May 6, 2004, provisional application No. 60/537,831, filed on Jan. 21, 2004.

(51) Int. Cl.
*B05D 33/34* (2006.01)
*B05D 55/00* (2006.01)

(52) U.S. Cl. ..... 292/307 R; 292/315; 292/317; 292/318; 292/322; 292/329; 292/DIG. 38; 24/16 PB

(58) Field of Classification Search ..... 292/307 R, 292/308, 208, 282, 317–323, 315, 325, 329, 292/330, DIG. 38; 24/16 PB, 16 R; 411/82, 411/388, 910, 913

See application file for complete search history.

(56) References Cited

U.S. PATENT DOCUMENTS 1,529,775 A * 3/1925 Dennett ..... 292/314
2,885,822 A * 5/1959 Onanian ..... 446/121

(Continued)

FOREIGN PATENT DOCUMENTS

EP 0537400 A1 4/1993

(Continued)

OTHER PUBLICATIONS

Various web pages from http://www.tydenbrammall.lu (9 pages).

(Continued)

*Primary Examiner*—Carlos Lugo
(74) *Attorney, Agent, or Firm*—Kaplan Gilman Gibson & Dernier LLP; Matthew B. Dernier

(57) ABSTRACT

An apparatus includes: a wire having a proximal end and a distal end; and a body being fixedly coupled to the proximal of the wire and having at least two apertures, each aperture for receiving and locking the distal end of the wire at different times such that when the wire is locked in one of the apertures it cannot be removed without destroying the apparatus, wherein the distal end of the wire is operable to pass through one or more apertures of an object and lock in each of the apertures at different times such that the body retains the wire in engagement with the one or more apertures of the object and maintains the apparatus locked to the object.

10 Claims, 24 Drawing Sheets

U.S. PATENT DOCUMENTS

| | | | | | |
|---|---|---|---|---|---|
| 3,290,080 | A | * | 12/1966 | Dawson | 292/322 |
| 3,600,027 | A | | 8/1971 | Noland | |
| 3,689,075 | A | * | 9/1972 | Adelsohn | 273/157 R |
| 3,975,040 | A | * | 8/1976 | Van Gompel | 292/318 |
| 4,038,725 | A | * | 8/1977 | Keefe | 24/704.2 |
| 4,093,288 | A | * | 6/1978 | Suzuki | 292/321 |
| 4,161,348 | A | * | 7/1979 | Ulrich | 385/115 |
| 4,280,726 | A | * | 7/1981 | McCoag | 292/327 |
| 4,420,857 | A | | 12/1983 | Clay | |
| 4,454,699 | A | * | 6/1984 | Strobl | 52/585.1 |
| 4,559,676 | A | * | 12/1985 | Paradis | 24/16 PB |
| 4,592,579 | A | * | 6/1986 | Burnett | 292/327 |
| 4,626,009 | A | * | 12/1986 | Burnett et al. | 292/327 |
| 4,728,132 | A | | 3/1988 | Brammall | |
| 4,802,699 | A | * | 2/1989 | Smith | 292/327 |
| 4,929,006 | A | * | 5/1990 | Tsay | 292/324 |
| 5,352,003 | A | | 10/1994 | Bystry | |
| 5,398,383 | A | * | 3/1995 | Bingold | 24/16 PB |
| 5,441,316 | A | | 8/1995 | Georgopoulos | |
| 5,685,682 | A | * | 11/1997 | Glime et al. | 411/510 |
| 5,749,610 | A | * | 5/1998 | Brammall et al. | 292/327 |
| 5,769,470 | A | * | 6/1998 | Toyomura | 292/327 |
| 6,009,731 | A | * | 1/2000 | Emmons et al. | 70/56 |
| 6,174,006 | B1 | * | 1/2001 | Burt | 292/307 A |
| 6,293,599 | B1 | | 9/2001 | Garcia | |
| 6,550,829 | B1 | | 4/2003 | Dobson | |
| 6,981,725 | B2 | * | 1/2006 | Debrody et al. | 292/307 R |
| 2003/0111846 | A1 | | 6/2003 | Brammall | |
| 2003/0178860 | A1 | | 9/2003 | Thomas | |
| 2004/0008585 | A1 | | 1/2004 | Augspurger | |
| 2004/0012211 | A1 | | 1/2004 | Burt | |
| 2004/0061340 | A1 | | 4/2004 | Debrody | |

FOREIGN PATENT DOCUMENTS

| | | | |
|---|---|---|---|
| JP | 0361710 | * | 3/1991 |

OTHER PUBLICATIONS

Various Web screen pages from Leghorn Suppliers at http://www.securityseal.com (8 pages).

High Security Container Seal HSC-RB advertisement page from American Casting & Manufacturing Corp.

Strap Guardian advertisement page from American Casting & Manufacturing Corp.

http://www.seton.com web page from Seton (1 page).

http://www.americancasting.com/products.asp?cat_id=16&prodid=22 web page from American Casting & Manufacturing Corp. (2 pages).

http://www.americancasting.com/products.asp?cat id=19&prodid=19 web page from American Casting & Manufacturing Corp. (2 pages).

http://www.tydenbrammall.com web page for Multiple Snap Loc Seal from Tyden Brammall (2 pages).

Various web pages from http://www.tydenbrammal.com web page for Reusable Bolt Loc Seal from Tyden Brammall (3 pages).

http://www.tydenbrammal.com web page from Tyden Brammall; Technical Data Super Bolt (1 page).

http://www.tydenbrammall.com web page from Tyden Brammall, Technical Data Multi Snap (1 page).

http://www.universealgroup.com web pages from Universeal, procuts page (3 pages).

High Security Cable Seals advertisement page from CGM Security Solutions, Inc. (1 page).

Snapper Bolt Seal advertisement pages from Stoffel Seals Security Solutions (2 pages).

http://www.stoffel.com/SecuritySeals/SecuritySeals.html web page from Stoffel Seals Security Solutions (1 page).

Brochure of Tyden Brammall offering various security seals (2 pages).

World Bolt advertisement page from Tyden Brammall (1 page).

Road BOSS (Bulldog Online Security System) advertisement page from Bulldog Technologies Inc. (1 page).

Gitcon Series G50 advertisement pages from Kaba Mas Corporation (2 pages).

Navalock Container Lock advertisement page from CGM Security Solutions, Inc. (1 page).

http://www.cgmsecuritysolutions.com/sw/swchannel/productcatalogcf_v2/internet/ProductCatalog.asp/PARENTID/23600/SWS... web page form CGM Security Solutions, Inc. (2 pages).

War Lok and Allies for Complete Cargo Security Solutions advertisement from Gabriel Technologies and Mega Fortis (2 pages).

http://www.magellans.com/jump.jsp?itemType=PRODUCT&itemID=1229&AID=102736... , (2004).

Advertisement from www.tydenbrammall.com of Reusable Bolt Loc Seal (Class D).

Advertisement from www.tydenbrammall.com of Multiple Snap Loc Seal (Class D).

Advertisement from www.tydenbrammall.com of Technical Data Multi Snap.

Int'l. Search Report of PCT/US04/42883, filed Dec. 20, 2004, Ching.

"TeviTag"—Stoffel Seals advertisement from http:/www.stoffel.com/SecuritySeals/TeviTag.html.

* cited by examiner

METHODS AND APPARATUS FOR FACILITATING SECURITY AND TAMPER CONTROL

CROSS REFERENCE TO RELATED APPLICATIONS

This application is a continuation-in-part of U.S. patent application Ser. No. 10/896,216 7,264,287, filed Jul. 21, 2004, which is based on and claims the benefit of U.S. Provisional Patent Application No.:60/568,619, filed May 6, 2004; and U.S. Provisional Patent Application No.:60/537,831, filed Jan 21, 2004, the entire disclosures of which are hereby incorporated by reference.

BACKGROUND OF THE INVENTION

The present invention relates to methods and apparatus for facilitating security and tamper controls and, more particularly, to providing a device that will indicate whether one or more items have been tampered with in an unauthorized manner.

The desire to eliminate tampering or other unauthorized access to information, services, goods, etc. is well known. Indeed, hundreds of years ago the use of locks, containers, personal guards, etc. were utilized in order to insure that only authorized individuals could gain access to valuable items. While it is often desirable to insure that unauthorized access is prevented, it may also be desirable and just as valuable to be provided with an indication that such unauthorized access has occurred. By way of illustration, an envelope may contain valuable documentation, where the envelope is sealed utilizing an adhesive mechanism in order to prevent unauthorized access to the documentation. Clearly, the envelope would not thwart the efforts of someone wanting to obtain the documentation; indeed, that individual would simply tear the envelope open to obtain the documents. On the other hand, once the envelope has been breached, it is difficult to return the documents and repair the envelope in a way which would conceal the fact that the envelope was breached. Thus, an authorized recipient of the envelope and/or the sender of the envelope would be able to determine whether tampering had occurred simply by inspecting the integrity of the envelope. Any tears, taping, or other evidence of breach would indicate that tampering may have occurred.

There are other devices in the prior art that provide a moderate obstacle to the unauthorized access of valuable items, although these devices suffer from a significant disadvantage. In particular, they may be breached and repaired in a way that may not be noticed by inspection. Even an envelope may be breached and repaired. Indeed, an envelope may be steamed open, the contents thereof removed and replaced, and the envelope may then be re-sealed utilizing an adhesive. Inspection of the re-sealed envelope may not reveal that tampering had occurred.

Similarly, other devices in the prior art, such as the PrivaSeal by Magellan's International of Santa Barbara, Calif., may also be repaired after tampering has occurred. The PrivaSeal device is made of a thermo-formed plastic material, which is in the shape of a standard padlock (except for the relative thickness, which is very thin). The loop of the device passes through the zipper tabs of a piece of luggage and a distal end of the loop snaps into the body of the device. Purportedly, once the loop has been snapped in, it cannot be removed without damaging the device (thereby providing an indication that tampering has occurred). As a practical matter, however, since the PrivaSeal device is formed from a single material (i.e., the body of the device is formed of plastic and the loop of the device is formed of plastic), the device may be repaired in a way which may be undetectable. For example, the loop may be severed anywhere along its length in order to gain access into the luggage, particularly at the ends. Thereafter, a suitable adhesive may be utilized to mend the severed loop, thereby repairing the device and concealing the fact that tampering has occurred.

In view of the foregoing, there are needs in the art for new apparatus for facilitating security and tamper control of valuable items.

SUMMARY OF THE INVENTION

In accordance with one more aspects of the present invention, an apparatus is provided that reduce the incidents of pilferage of sensitive items. The apparatus may include a body made of plastic, metal or metal alloy, or combination of both, a wire coupled at one end to the body, made of copper or any other metal, plastic or combination of both, and an umbrella-like structure made of plastic, metal, metal alloy or combination of both disposed at another end of the wire. The umbrella-like structure (or head) may lock into the body. Notably, the head may not be removed from the body without damaging the device. By way of example, in use the head and wire may be passed through the loops of a piece of luggage such as a zipper (or any other aperture that can be used to seal or enclose an item of interest). Next, the head is inserted into the body and is locked in place. Thus, the loops of the zipper may not be separated because the body and the wire of the device prevents their separation. Notably, the insertion of the head into the body does not result in a rigid, non-movable relationship between the head and the body; rather, the head is locked in the body but may be moved slightly in and out when properly engaged.

In order to breach the device, an unauthorized person would have to permanently damage the body, the head, the wire, or the loops of the luggage. If the body or the head of the device are damaged, then an attempt at repair may include gluing the head back into the body. At first blush, this would appear to conceal that tampering had occurred; however, proper inspection would clearly show that unauthorized access took place. Indeed, once the head is glued into the body, there would be no slight movement of the head within the body, thereby revealing that tampering had taken place. Alternatively, if the wire is cut, it may not be glued back together since the wire is formed of metal, such as copper, or combination of metal and plastic. Indeed, a copper wire may only be welded or soldered back together, which would clearly be visible to the naked eye.

In accordance with one or more further aspects of the present invention, an apparatus may include: a wire having a proximal end and a distal end; and a body being fixedly coupled to the proximal of the wire and having at least two apertures, each aperture for receiving and locking the distal end of the wire at different times such that when the wire is locked in one of the apertures it cannot be removed without destroying the apparatus, wherein the distal end of the wire is operable to pass through one or more apertures of an object and lock in each of the apertures at different times such that the body retains the wire in engagement with the one or more apertures of the object and maintains the apparatus locked to the object.

In accordance with one or more further aspects of the present invention, an apparatus may include: two or more heads coupled to one another in series; a wire having a first end coupled to a last of the heads and a second end; a body being fixedly coupled to the second end of the wire and having two or more cavities for receiving and locking respective ones of the heads, wherein the heads and the wire are operable to pass through one or more apertures of an object, the first head is operable to lock in a first of the cavities such that the body retains the wire in engagement with the aperture and maintains the apparatus locked to the object.

In accordance with one or more further aspects of the present invention, an apparatus may include: a shaft having a first end coupled to a head and a second end coupled to a stop member; a wire having a first end coupled to the shaft and a second end; and a body being fixedly coupled to the second end of the wire and having a cavity for receiving and locking the head such that when the head is locked in the cavity it cannot be removed without destroying the apparatus, wherein the head and the shaft are operable to pass through one or more apertures of an object and the head is operable to lock in the cavity such that the body and the stop member retain the shaft in engagement with the aperture and maintain the apparatus locked to the object.

Other aspects, features, and advantages of the present invention will become apparent to one of ordinary skill in the art when the description herein is taken in conjunction with the accompanying drawings.

BRIEF DESCRIPTION OF THE DRAWINGS

For the purposes of illustration, forms are shown in the drawings that are preferred, it being understood, however, that the present invention is not limited to the precise arrangements or instrumentalities shown.

DETAILED DESCRIPTION OF THE PREFERRED EMBODIMENTS

Figure 1:
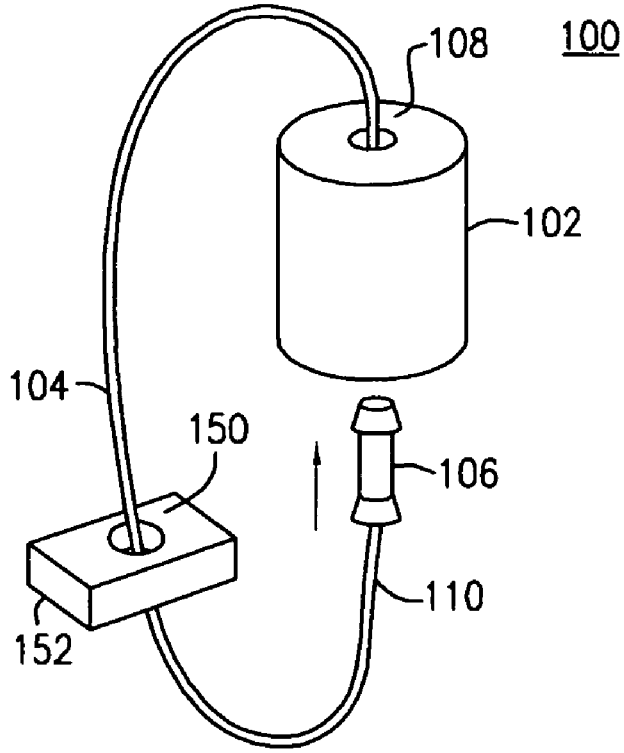
FIG. 1 is a perspective drawing of a security device in accordance with one or more aspects of the present invention.

Reference is now made to the drawings, wherein like numerals indicate like elements. FIG. 1 is a perspective view of a security device 100 in accordance with one or more aspects of the present invention. The security device 100 includes a body 102, a wire 104 and a head 106. In this embodiment of the invention, the wire 104 is coupled at one end 108 to the body 102. Another end 110 of the wire 104 is coupled to the head 106. Preferably, the body 102 and the head 106 are formed from a suitable plastic material, metal, metal alloy or combination of plastic and metal, and the ends 108, 110 of the wire 104 are preferably embedded into the body 102 and the head 106, respectively, during the manufacturing process.

The body 102 is preferably of a generally cylindrical configuration, although those skilled in the art will appreciate that the body 102 may take on any desirable shape without departing from the spirit and scope of the invention. In use, the head 106 preferably passes through one or more apertures 150 of an object of interest 152. As discussed above, the object 152 may be a piece of luggage, although the particular nature of the object 152 is not critical to the invention. For the purposes of discussion, however, the object 152 may be a stack of papers, a box or other enclosure, an envelope, a pouch, a pocketbook, a wallet, a safe, etc. Once the head 106 and a portion of the wire 104 pass through the aperture 150, the head 106 is inserted into the body 102 in the direction indicated by the arrow.

The size, shape, and contour of the head 106 is preferably configured such that when it is inserted into the aperture of the body 102, it cannot be removed without damaging either the head 106 or the body 102. It is most preferred that the head 106 is permitted to move slightly within the body 102 after a locked engagement therebetween has been achieved. In this manner, neither the body 102 nor the head 106 may be damaged and then repaired by gluing the head 106 back into the body 102 without being detected. Indeed, after locked engagement has been achieved, if the head 106 is glued into the body 102, then the tampering may be detected vis-à-vis the lack of movement of the head 106 within the body 102.

Figure 2:
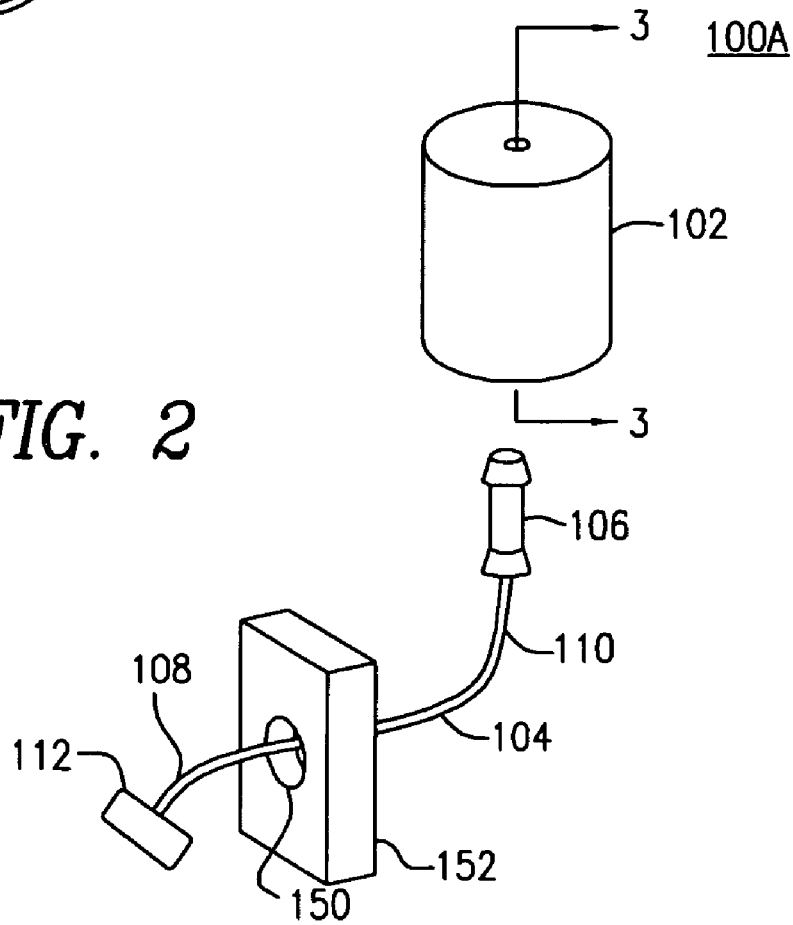
FIG. 2 is a perspective view of an alternative configuration of the security device of FIG. 1.

FIG. 2 is a perspective view of a security device 100A that is similar to the security device 100 of FIG. 1, except that the end 108 of the wire 104 is not connected to the body 102. Instead, the end 108 of the wire 104 is connected to a stop member 112 (again, preferably during the manufacturing process). In use, the head 106 passes through the aperture 150 of the item of interest 152 and then is locked into the body 102. The stop member 112 prevents the end 108 of the wire 104 to pass through the aperture 150, thereby locking the device 100A to the item of interest 152.

Preferably, the wire 104 of the security devices 100, 100A is formed from a metal that may be bent as desired. For example, the wire 104 may be formed from copper, a copper alloy, a brass, a brass alloy, aluminum, an aluminum alloy, steel, a steel alloy, etc., or a combination of metal and plastic. It is most preferred that the wire 104 is formed of copper. Advantageously, if the wire 104 is cut in order to tamper with the item 152, it cannot be glued back together. Indeed, the wire 104 would have to be welded or soldered together, which would be clearly visible to the naked eye. Alternatively, if either end 108, 110 of the wire 104 were cut or otherwise extracted from the body 102 or the head 106, then the plastic material thereof would exhibit permanent deformation, which also would be clearly visible. Any attempt to glue the wire 104 back into the body 102 and/or the head 106 would also be visible, particularly since the body 102 and head 106 are formed from dissimilar materials than the wire 104 (i.e., plastic versus metal). The use of dissimilar materials as between the body 102 and the wire 104 as well as between the head 106 and the wire 104 advantageously mitigates against the ability of an unauthorized person to repair the security device 100, 100A and conceal that tampering has occurred.

Figure 3:
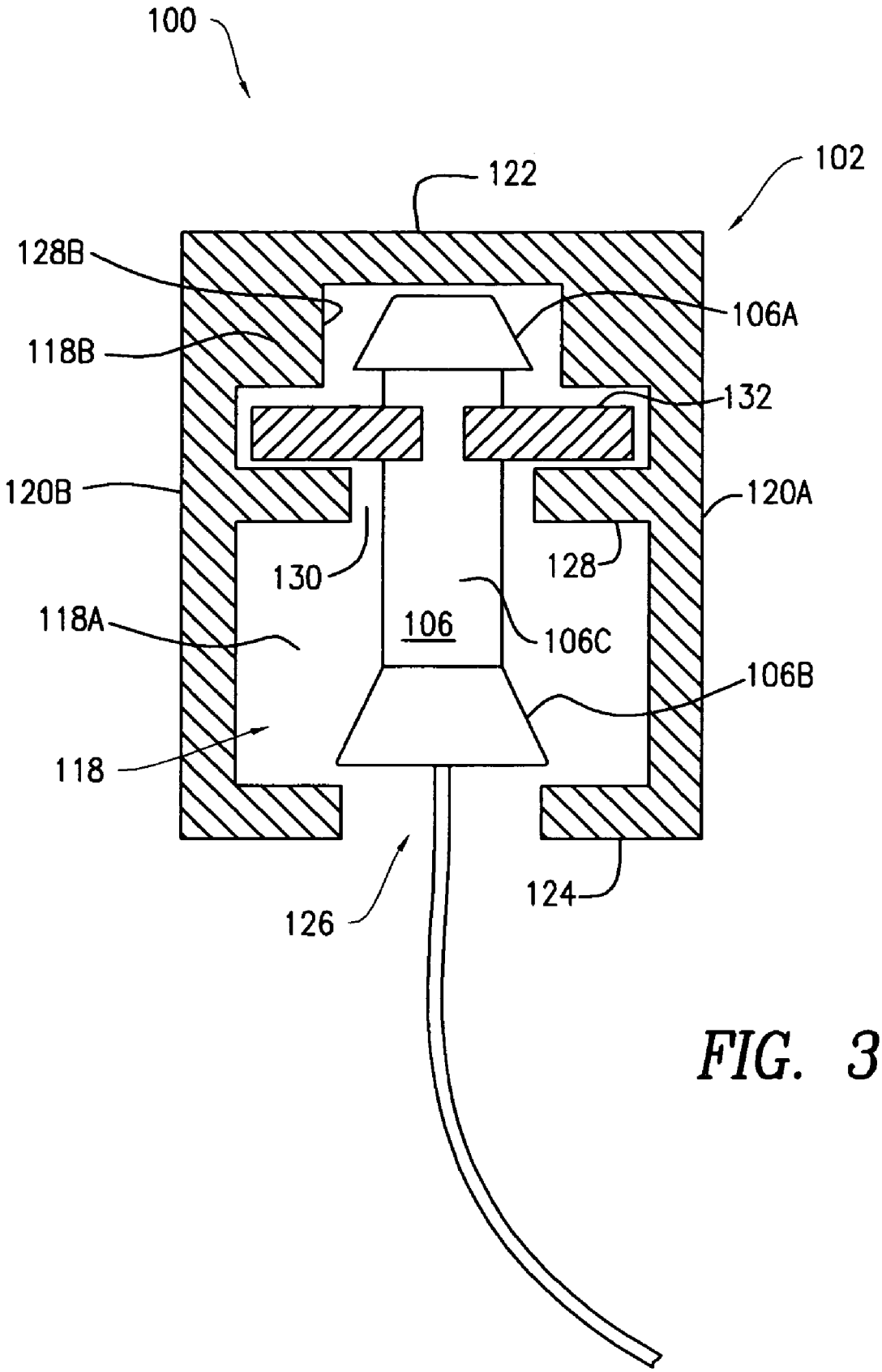
FIG. 3 is a cross-sectional view of the security device of FIGS. 1 and/or 2 taken through line 3-3 of FIG. 2.

Reference is now made to FIG. 3 which is a cross-sectional view of the body 102 taken through line 3-3 of FIG. 2. It is understood that the cross-sectional view of the body 102 of FIG. 1 would be substantially similar to that illustrated in FIG. 3. The body 102 defines an interior volume 118 by way of walls 120A, 120B, top 122, and bottom 124. As noted above, the walls 120A, 120B, the top 122, and the bottom 124 cooperate to form a generally cylindrical shape. It is understood, however, that a parallelepiped structure (e.g., FIG. 6) may also be formed without departing from the spirit and scope of the invention. Indeed, those skilled in the art will understand from the description herein that the body 102 may take on any shape so long as it is capable of receiving and engaging the head 106, which will be discussed below.

The bottom 124 of the body 102 includes an aperture 126 therethrough that is operable to receive the head 106. The size and shape of the aperture 126 is preferably configured in correspondence with the size and shape of the head 106. For example, when the head 106 has a generally circular cross-section, then the aperture 126 may be of circular configuration. Further, the aperture may be slightly larger, of equal size, or may be slightly smaller than the major diameter of the head 106.

The body 102 preferably further includes an interior wall 128 extending transversely from an interior surface of the wall or walls, 120A, 120B. In this embodiment, the interior wall 128 may be of a generally circular configuration as it extends radially inward from the inner surface of the walls 120A, 120B. The interior wall 128 is preferably disposed between the top 122 and the bottom 124 such that it creates separate interior volumes 118A and 118B. The interior wall 128 preferably further includes an aperture 130 that is sized and shaped to receive at least a portion of the head 106. A further interior wall 128*b* extends into the interior volume 118B above a locking mechanism 132 (which will be discussed below).

The body 102 preferably further includes a locking mechanism 132 that is operable to engage at least a portion of the head 106 and retain same in the body 102 when the head 106 is inserted through the aperture 126 and through the aperture 130. In this embodiment, the locking mechanism 132 may take the form of a split ring, which is sized to receive and engage a forward portion 106A of the head 106.

The head 106 preferably includes a rear portion 106B, a central portion 106C, and the aforementioned forward portion 106A. The forward portion 106A preferably includes a beveled edge of a generally annular configuration, where the beveled edge is operable to movingly engage the aperture 126 and the aperture 130 of the body 102 when the head 106 is inserted into the body 102. Preferably, the diameters of the aperture 126, the aperture 130, and the beveled surface of the forward portion 106A of the head 106 are sized such that the forward portion 106A of the head 106 may pass through the apertures 126, 130 without substantial interference that would prevent insertion of the head 106. On the other hand, it may be desirable to have some level of interference so that the head 106 may not be removed from the body 102 once inserted therein.

The rear portion 106B of the head 106 also preferably includes a beveled surface of a generally annular configuration. Preferably, the diameter of the beveled surface is sized such that some level of interference with the aperture 126 is achieved when the head 106 is inserted into the body 102 and retained therein. Indeed, as shown in FIG. 3 the major diameter of the beveled surface of the rear portion 106B is of such a size as to resist removal of the head 106 from the body 102 once the head 106 is received therein. Advantageously, however, the beveled surface of the rear portion 106B movingly engages the aperture 126 such that the head 106 may be received into the body 102 through the aperture 126 despite the fact that the aperture 126 may be of slightly smaller diameter than the rear portion 106B of the head 106.

The locking mechanism 132, which is preferably of a split annular ring configuration preferably retains the forward portion 106A of the head 106 within the body 102 once the head 106 is inserted therein. In particular, the locking mechanism 132 preferably includes an aperture therethrough that is sized to engage the forward portion 106A of the head 106 when inserted. As may be seen in FIG. 3, the beveled surface of the forward portion 106A of the head 106 may movingly engage the aperture of the locking mechanism 132 as the head 106 is pressed into the body 102. The split ring of the locking mechanism 132 may springingly expand as the beveled surface is pressed through the aperture of the locking mechanism 132. Once the major diameter of the beveled surface of the forward portion 106A passes through the aperture of the locking mechanism 132, the split ring configuration may snap back into its resting position and lock the forward portion 106A of the head 106 within the body 102.

Figure 11:
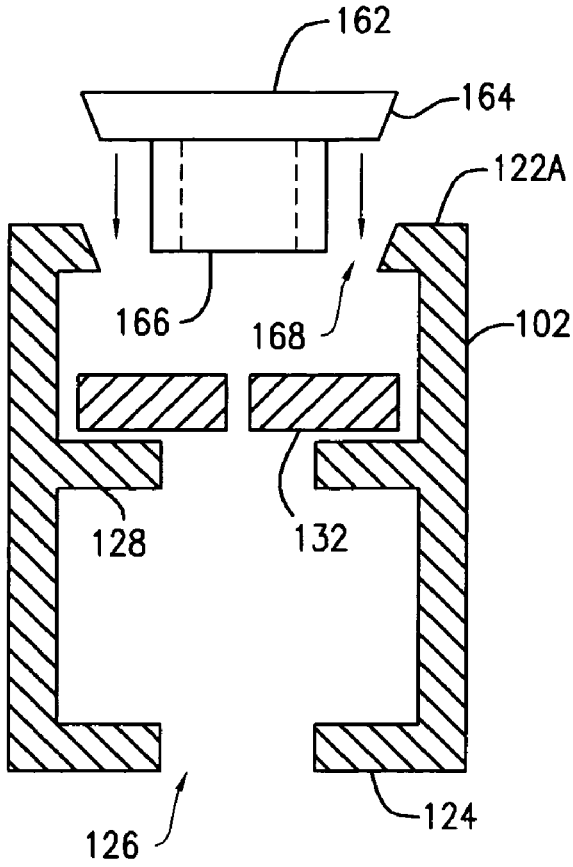
FIG. 11 is a cross-sectional view of an alternative embodiment of the security device of FIGS. 8-10 in accordance with one or more further embodiments of the present invention.

The locking mechanism 132 is preferably retained in proximity to the interior wall 128 by way of any of the known techniques, such as a groove or channel (not shown), fastening means, etc. A preferred approach to retaining the locking mechanism 132 in proximity to the interior wall 128 is illustrated in FIG. 11. As shown, the top 122A of the body 102 includes an opening 168 in which a cover 162 may be received. Preferably, the edge of the opening 168 is chamfered (or beveled) to facilitate engagement with a corresponding edge 164 of the cover 162. The cover 162 preferably includes an extension 166 of generally cylindrical construction extending away from a top portion of the cover 162. A bottom edge of the extension preferably biases the locking mechanism 132 toward the interior wall 128 when the cover engages the top 122A.

Turning again to FIG. 3, the head 106 is advantageously retained in the body 102 by way of at least two interference fits. First, there is an interference fit as between the major diameter of the beveled surface of the rear portion 106B of the head 106 and the diameter of the aperture 126. Second, there is an interference fit as between the major diameter of the beveled surface of the forward portion 106A of the head 106 with respect to the locking mechanism (e.g., split ring) 132. This ensures substantial engagement of the head 106 within the body 102 once the head 106 is inserted therein.

Preferably, the diameter of the central portion 106C of the head 106 is such that it may slightly move through the locking mechanism 132 even after the head 106 is engaged within the body 102. Further, the length of the interior volume 118 is preferably such that the head 106 may slightly move within the body 102 even after it is engaged therein. Thus, even after the head 106 is locked within the body 102, the security device 100 may be inspected for tampering by grasping the wire 104 and determining whether the head 106 may move within the body 102 slightly. If no movement is evident, then it may be determined that the security device 100 has been tampered with, for example, by forcing the head 106 out of the body and then repairing same by gluing the head 106 within the body 102. Advantageously, however, this provides an indication to an inspector that tampering has occurred.

The tapered shape of the beveled portions 106A, 106B helps to guide the head 106 through the apertures 126, 130 when the head 106 is inserted into the body 102, thus the forward portion 106A can easily find and pass the aperture 130 without undue efforts.

As shown in FIG. 3, when the head 106 is made of a material that has some resilience, such as plastic, the size (i.e., the diameter of the bottom) of the rear portion 106B can be slightly larger than the aperture 126. Thus, with the help of its resilience as well of its beveled shape, the rear portion 106B can be easily pushed through the aperture 126 into the body 102 with a little deformation. However, after the rear portions 106B enters the body 102, it resumes its original shape (with its bottom diameter larger than that of the aperture 126) and helps to prevent the head 106 be pulled out from the aperture 126.

Alternatively, the rear portion 106B can be omitted, and the head 106 is held inside the body 102 solely by the engagement of the forward head 106A and the split ring 132. Alternatively, the rear portion 106B is slightly smaller than the aperture 126, thus it only works to help the forward portion 106A to find and pass the aperture 130.

Figure 11A:
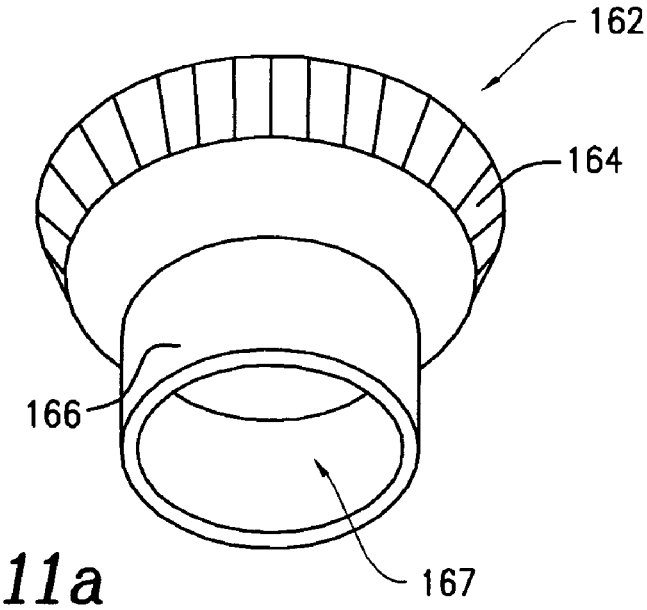
FIG. 11*a* is a perspective view of an element of the security device of FIG. 11.

As noted above, the body 102 may include the cover 162. With reference to FIG. 11*a*, the cover 162 is preferably designed such that desirable movement of the head 106 within the body 102 is achieved. In particular, the extension 166 includes a recess or aperture 167 that is sized and shaped to receive the forward portion 106A of the head 106 when engaged. Indeed, the aperture 167 is in alignment with the apertures 126 and 130 (and 160 if applicable) such that the forward portion 106A and at least a part of the central portion 106C of the head 106 pass into the aperture 167.

Figure 4:
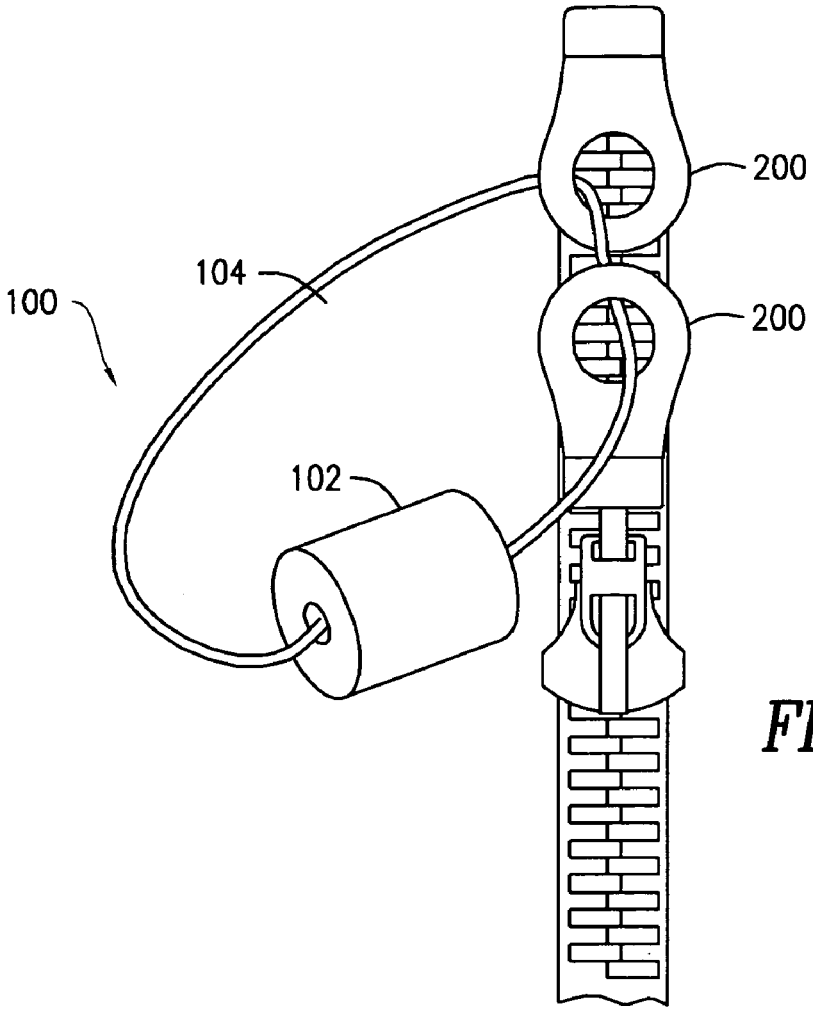
FIG. 4 is a perspective view of the security device of FIG. 1 in use.

Reference is now made to FIG. 4, which is a perspective view of the security device 100 of FIG. 1 in use so as to secure a pair of loops 200 of a zipper. As may be seen in FIG. 4, the head 106 has passed through the loops 200 of the zipper and has been engaged within the body 102. Thus, the wire 104 passes through the loops 200 and prevents them from being separated. As such, any contents within a compartment closed by the zipper are secured in a sense that they may not be accessed without destroying the security device 100 in a way that may be detected thereafter.

Figure 5:
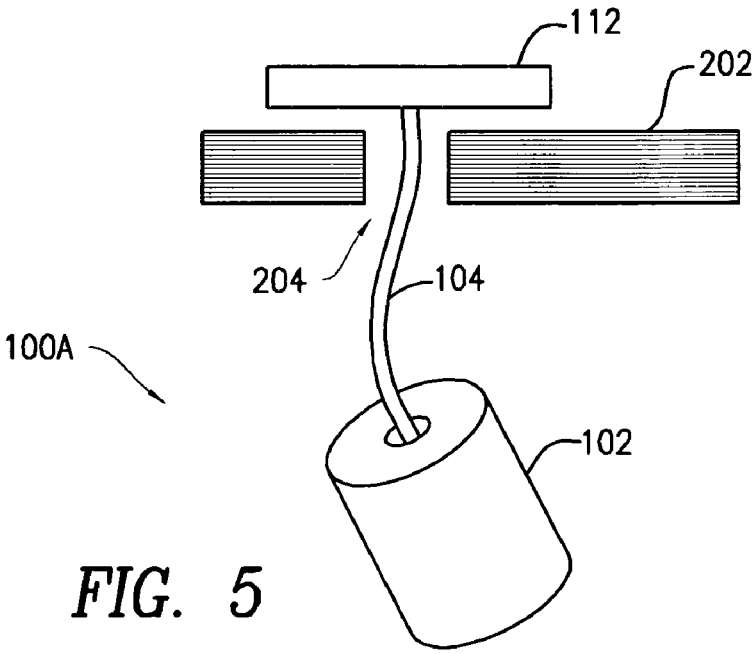
FIG. 5 is a perspective view of the security device of FIG. 2 in use.

FIG. 5 is a perspective view of the security device 100A of FIG. 2 in use to secure a stack of papers 202 together. In particular, an aperture 204 is formed through the papers 202, the head 106 passes through the aperture 204 and is locked into the body 102. The stop member 112 and the body 102 prevent the security device 100A from separating from the paper 202.

Figure 6:
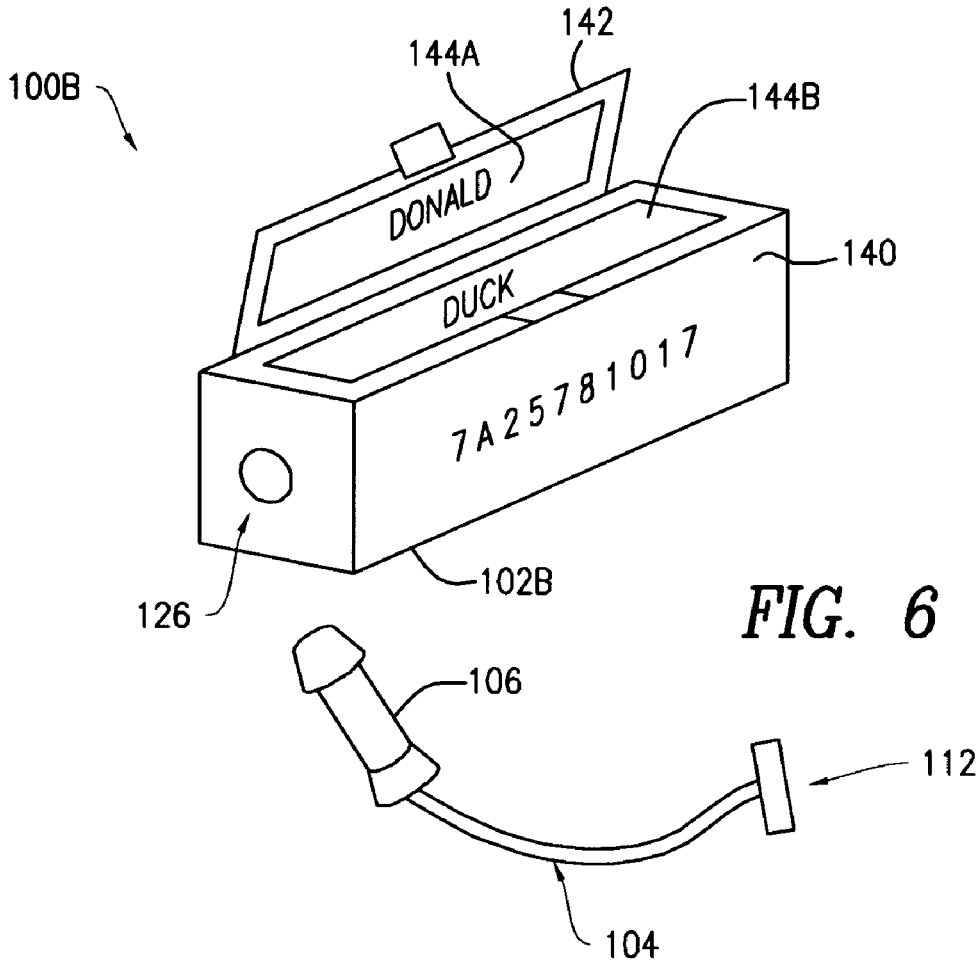
FIG. 6 is a perspective view of a security device in accordance with one or more further aspects of the present invention.

FIG. 6 is a perspective view of an alternative configuration of a security device 100B in accordance with one or more further aspects of the present invention. The security device 100B includes a body 102B that is of a substantially parallelepiped configuration. The body 102B preferably includes one or more of the details illustrated in FIG. 3 in connection with receiving the head 106 therein. Preferably, the body 102B includes at least one surface 140 for receiving indicia thereon. Preferably, the indicia is a non-repeating serial number that may be recorded in a secure location and utilized at some point to authenticate the item or items to which the security device 100B is affixed. Still further, the body 102B preferably includes a hinged lid 142 that may be opened to reveal one or more surfaces 144A, 144B. These surfaces 144A, 144B may preferably include further indicia that may be used to authenticate the security device 100B and/or the item or items to which it is affixed. For example, the surfaces 144A, 144B may include further serial numbers, signatures, passwords, pin numbers, etc.

Figure 7:
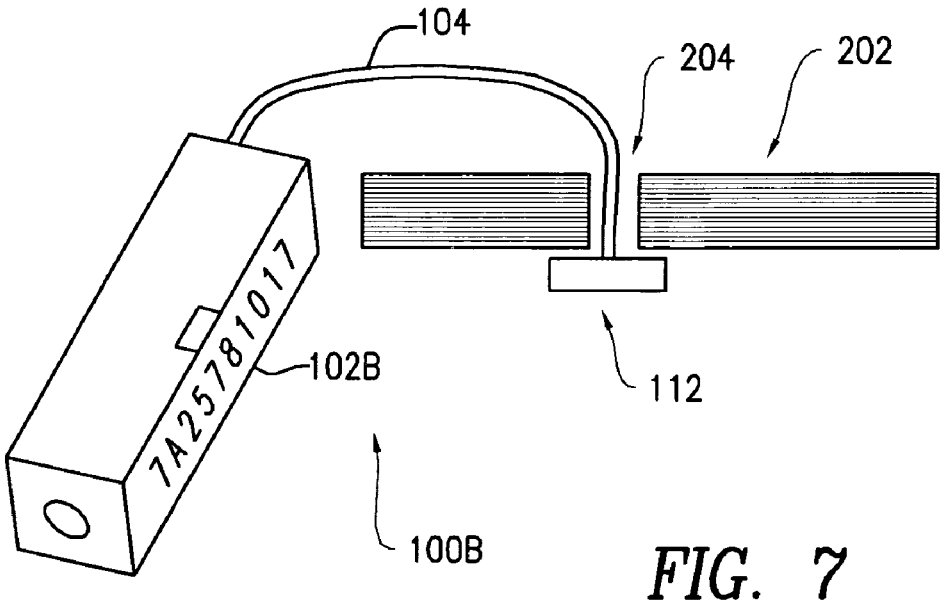
FIG. 7 is a perspective view of the security device of FIG. 6 in use.

FIG. 7 illustrates the security device 100B of FIG. 6 in use in connection with affixing same to a stack of papers 202. The aperture 204 is preferably a normally sized punched-out hole that one would place through a stack of papers. Advantageously, the wire 104 may be pushed down to tighten the papers together and insure that the security device 100B is unobtrusive. Advantageously, the indicia on the surface 140 and/or the indicia on the surfaces 144A, 144B may be utilized to authenticate the papers 202.

Figure 8:
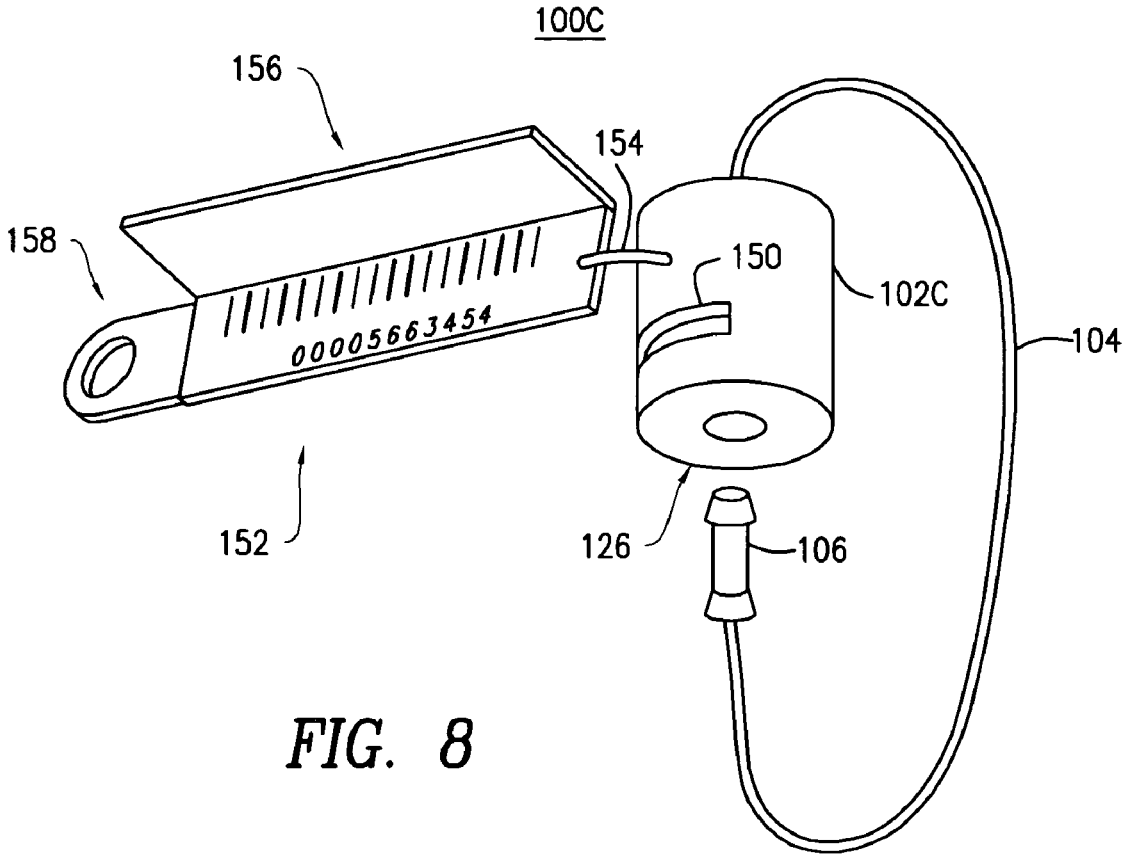
FIG. 8 is a perspective view of a security device in accordance with one or more further aspects of the present invention.

Reference is now made to FIG. 8, which is an alternative embodiment of a security device 100C in accordance with one or more further aspects of the present invention. The body 102C of the security device 100C is preferably of substantially similar construction as the aforementioned bodies of the previous designs. The body 102C, however, is preferably operatively coupled to at least a portion of a tag 152. For example, the tag 152 may include a projection 154 that is operatively coupled to the body 102C, preferably during a manufacturing process, such that the tag 152 is not separable from the body 102C. The tag 152 is preferably of a generally rectangular configuration and includes at least one surface for receiving indicia, such as a signature, serial number, pin, etc. In a preferred embodiment, the tag 152 preferably includes a hinged lid 156 that may be opened to reveal the indicia and closed to encase the indicia. It is also preferred that the lid 156 and/or other portions of the tag 152 be formed from a substantially transparent material such that the indicia may be seen even when the lid 156 is closed.

Figure 9:
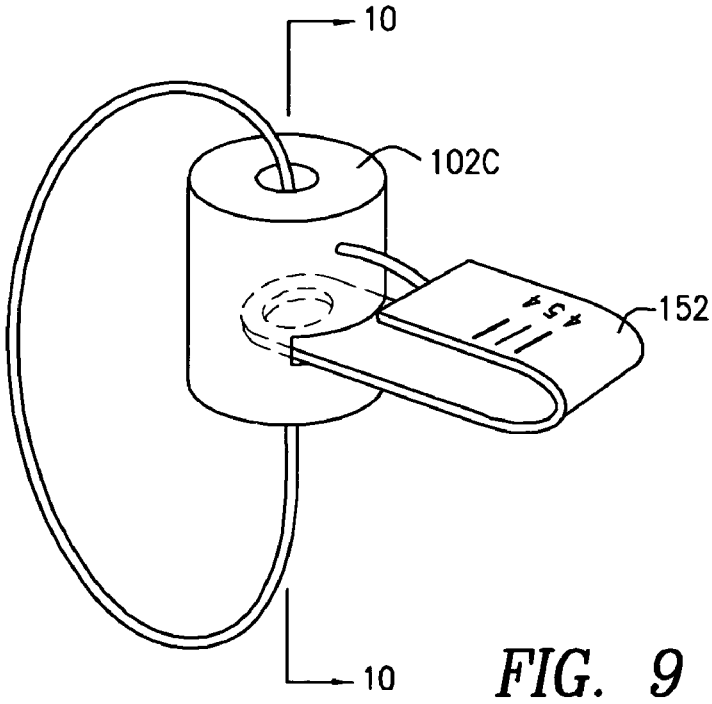
FIG. 9 is a perspective view of security device of FIG. 8 in use.

Preferably, the tag 152 includes at least one ring 158 that may be received into a slot 150 of the body 102C and retained therein when the head 106 is received into the body 102C. With reference to FIG. 9, the tag 152 is preferably bent such that the ring 158 may be inserted into the slot 150 of the body 102C. Then, the head 106 may be inserted into the body 102C in order to secure the ring 158 within the body 102C. Advantageously, once the tag 152 is bent into this configuration, the lid 156 may not be lifted and the indicia therein may not be tampered with. On the other hand, the indicia may be seen through the transparent lid 156 upon inspection. As will be discussed hereinbelow, this embodiment of the invention has particular applicability for use in airport security.

Figure 10:
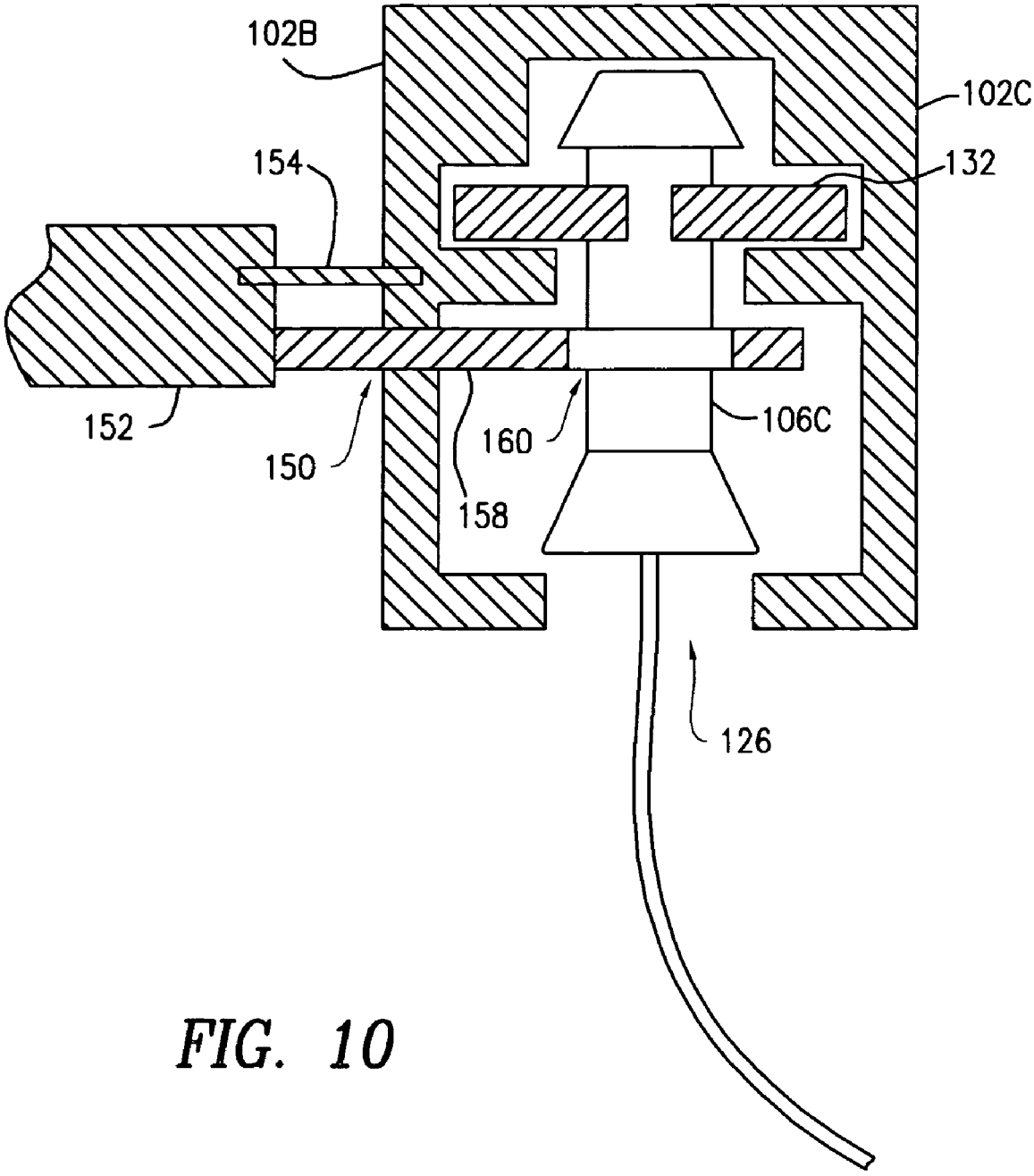
FIG. 10 is a cross-sectional view of the security device of FIGS. 8-9 in use.

Reference is now made to FIG. 10, which is a cross-sectional view of the body 102C of FIG. 9 taken through line 10-10. The detailed construction of the body 102C is preferably substantially similar to that of the body 102 of FIG. 3. As discussed above, however, the body 102C of FIG. 10 includes the slot 150 that is operable to receive the ring 158 of the tag 152. As may be seen in FIG. 10, an aperture 160 of the ring 158 preferably aligns with the apertures 126 and 130 of the body 102C such that the central portion 106C of the head 106 passes through the aperture 160 and retains the ring 158 within the body 102C.

Figure 12:
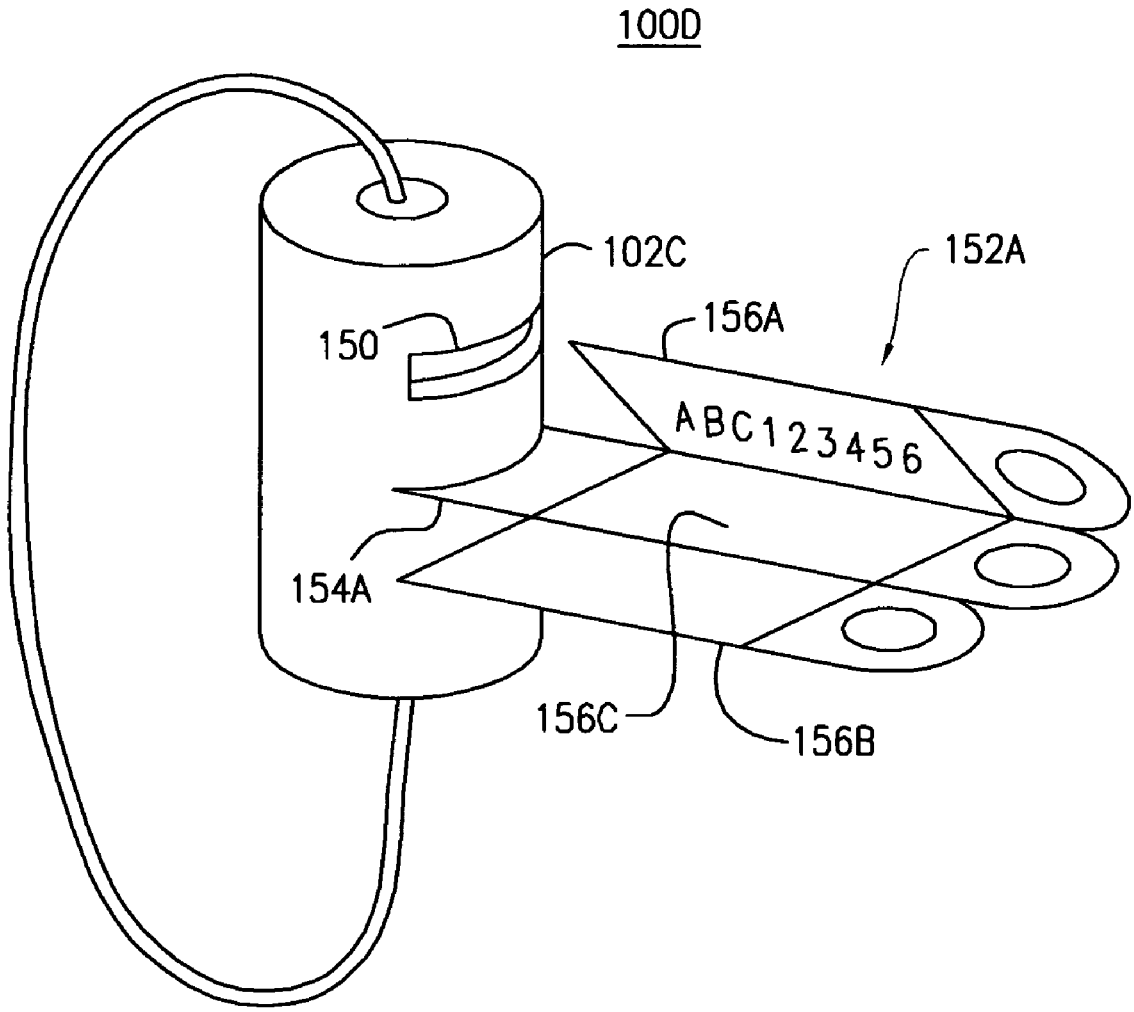
FIG. 12 is an alternative embodiment of a security device in accordance with one or more further embodiments of the present invention.

An alternative embodiment of a security device 100D in accordance with one or more further aspects of the present invention is illustrated in FIG. 12. In this embodiment of the invention, the connector 154A is formed as a substantially thick member, preferably clear plastic. This is desirable because any attempt to remove the tag 152A and re-connect it via, for example, glue would be easily detected by way of the clear plastic. The tag compartment includes a first lid 156A and a second lid 156B. By way of example, after the indicia is placed on the first lid 156A, the first lid 156A is folded over the central portion 156C. Then the second lid 156B is folded over the first lid 156A. In this manner, the indicia is in the center of a sandwich of lids and securely protected from tampering. The lids 156A, 156B and the central portion 156C include respective rings that align and are in registration such that they may be received in the slot 150 as discussed above. Of course, there are many variations as to where the indicia may be placed vis-à-vis the lids 156A, 156B and the central portion 156C without departing from the spirit and scope of the invention.

The security devices discussed hereinabove, particularly that illustrated in FIGS. 8-12, provide substantial advantages to an airline, train or other vehicle passenger who wants his checked-in-baggage locked. They also provide advantages for the airline in managing the handling of checked baggage and reducing internal pilferage, and for security personnel conducting searches of the checked-in-baggage. Indeed, the devices provide security control over baggage within the system from having items inserted into checked baggage.

The device permits a secure, simple and low-cost approach to provide a more efficient mode of handling checked-in-luggage at all stages of the process using current baggage tagging procedures in place at the airlines.

The plastic tag 152 is attached to the device 100C, where the specific bag identification number is affixed under the lid 156. There are various methods of attaching the plastic tag container, e.g., directly to the body 102C or via the ring 158. The tag 152 is preferably constructed with ridges that makes it very difficult to remove the baggage identification tag number affixed to it without destroy the identification tag. The identification tag 152 provides the customer with the assurance that the tag 152 was originally attached to his bag at the time that such luggage was checked-in. The passenger does not have to remember a different number, and has a method of showing the airline, and the airline of being able to verify, that his bag has not been opened since check-in.

The airlines may need to modify their tagging equipment to provide for perforated or cut tags, to specifications, that can be affixed once, but then are separated and damaged if such tag is pulled out of the plastic tag container.

The only way to remove the security device 100 is by either cutting the wire 104 or by cutting out the head 106 from the body 102, in both cases by destroying the device 100. Attempts at tampering with the device 100 are noticeable. The identifying baggage tag number cannot be removed from the plastic tag container (and placed on a new device) without destroying the identifying tag 152.

It is noted that any of the security devices discussed above or later in this description may be outfitted with a radio device chip (RFI Chip), an RF tag, a magnetic tag, etc. that allows for easier tracking and monitoring of designated checked-in-luggage if so desired.

The security device 100 may be physically attached to the checked-in-bag through the zipper head elements 200 of a zippered bag or through other fastening rings or devices provided by the manufacturer for traditional padlocks. The security device 100 may be attached either at curbside check-in or at the counter since bar coded luggage identification machinery is available to print the luggage tag affixed to the bag. The handler can quickly insert the bar coded identification number into the plastic tag container of the tag 152 and lock the security device 100. Preferably, the identification number (or other indicia) is small and detachable with respect to the tag 152.

If a bag is selected for search by authorized agents of the Department of Transportation, or of other appropriate agencies, then such agents can quickly cut the wire 104 of the device 100. No more looking for master keys to cut padlocks or for cutting the padlock that then cannot be replaced and accordingly, such bag continues through the handling process unlocked.

After the search is conducted, the agents can attach a new security device 100 bearing other identifying colors or other insignias indicating that the device is newly attached (e.g., NEW SECURITY LOCK) if this is appropriate. With a scanning device, the DOT Agents can then duplicate the tag identification number on the bag, and attached this same identification number into the new specialized plastic container of the tag 152. The old identifying code tag 152 must be cut or perforated to prohibit reuse. The checked-in-luggage bag continues to remain locked from this point forward until received by the passenger at his point of destination. The passenger can then confirm whether his bag was opened by security personnel or by any one else while it was checked in.

An alternative methodology prescribes that the baggage handling personnel (such as the check-in person) produces two bar coded and/or numbered labels (either at curbside or at the counter) and inserts one of the labels into the tag 152. The bar coded and/or numbered labels are preferably small and detachable. The other label is saved for authorized agent (e.g., the DOT) to use on the new security device 100 after a search/inspection is completed. If no search/inspection is performed and the device 100 is not destroyed, then the other label should be destroyed prior to the luggage proceeding toward loading on the aircraft (e.g., on the conveyor).

The device 100 can be easily removed at the baggage claim area by baggage handlers after the passenger obtains his luggage, if the passenger so instructs, or can be removed by hotel personnel if instructed by the passenger in his hotel room, or can be removed at home by the passenger. A passenger can use his conventional locks once he retrieves his bags at the airport, and can lock his bags using conventional locks until he reaches the appropriate airport check-in location, at which time he unlocks his bag.

Figure 13A:
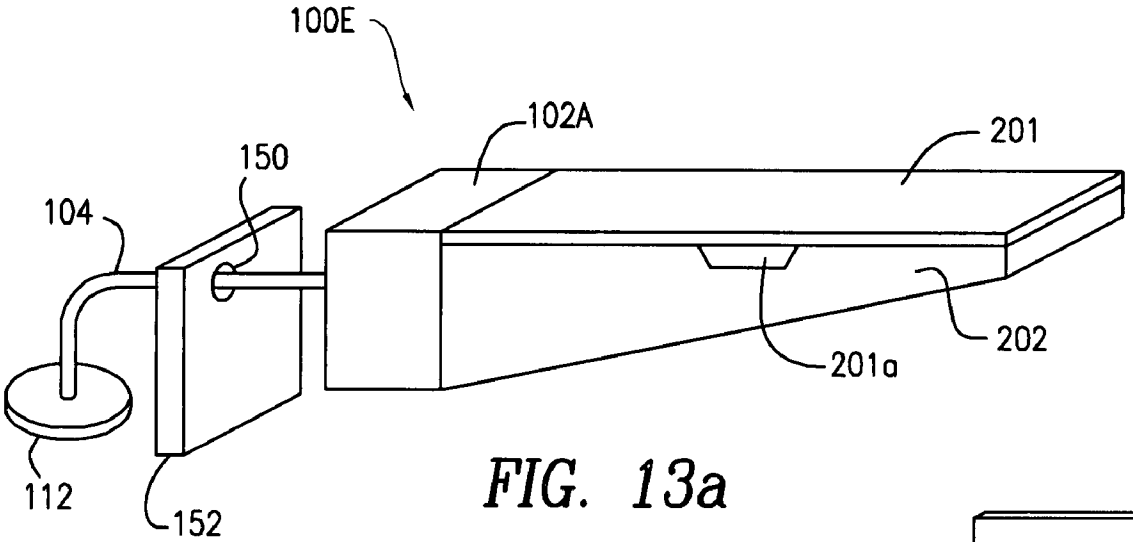
FIGS. 13*a*-13*c* show another embodiment of the security device of the present invention.
Figure 13B:
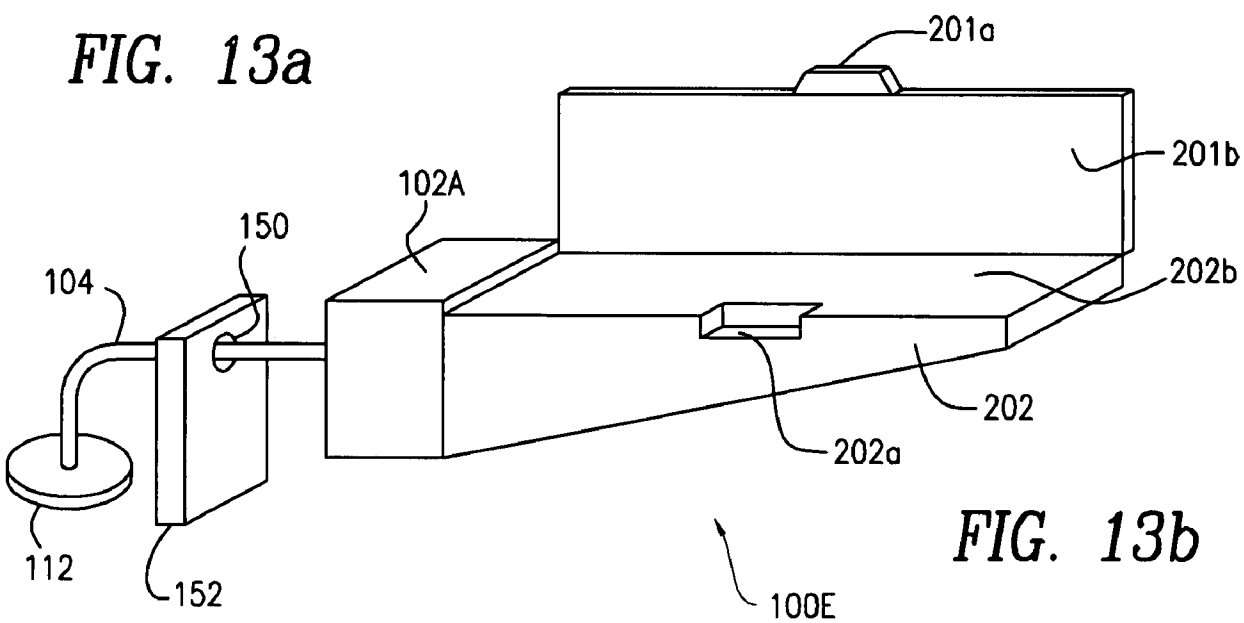
Figure 13C:
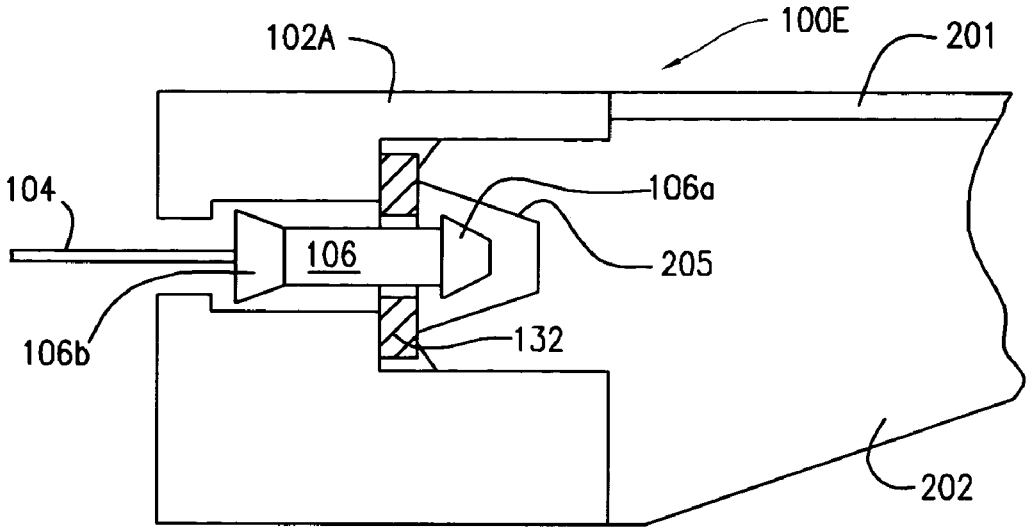

FIGS. 13*a*-13*c* illustrate another embodiment of the security device 100E according to the present invention, typically for holding a document 152, e.g., a stack of papers. Similar to the embodiment shown in FIG. 2, the device 100E shown in FIGS. 13*a*-13*c* is provided with a stop member 112 at an end of the wire 104 for preventing document(s) 150 from separating from the wire 104 after the head 106 is accepted into the body or casing 102A (as shown in FIG. 13*c*). An indicia member 202 extends from the body 102. The indicia member 202 has an upper surface 202*b* normally covered by a cover plate 201. The cover plate 201 is pivotably movably between a close position (FIG. 13*a*) to cover the upper surface 202*b* and an opened position (FIG. 13*b*) to expose the upper surface 202*b*. Preferably, the cover plate 201 is provided with a tab 201*a* for engaging a notch 202*a* formed on a front edge of the upper surface 202*b* when the cover plate 201 is in its closed position. The cover plate 201 is provided with an inner surface 201*b*. Both the inner surface 201*b* and the upper surface 202*b* are suitable to bear indicia for authenticating or identifying the document held by the device. For example, the inner surface 201*b* may bear a first signature, and the upper surface 202*b* may bear a second signature. Moreover, the indicia element 202 may further have a non repeating number or letter inscribed or otherwise provided thereon.

As shown in FIG. 13*c*, similar to the previous embodiment, when the head 106 is inserted into the casing 102, the forward portion of the head 106 passes the split ring 132 and is retained by the split ring 132. The left end of the indicia member 202 (like the cover 162 in FIG. 11) is operable to retain the split ring 132 inside the casing 102A, and provide a space to accommodate the forward portion 106*a* and allow the head 106 to move slightly inside the casing 102A. It is noted that the casing 102A includes a frustoconical section 205 that provides a cap-like portion against which the forward portion 106*a* of the head 106 can rest.

Figure 14:
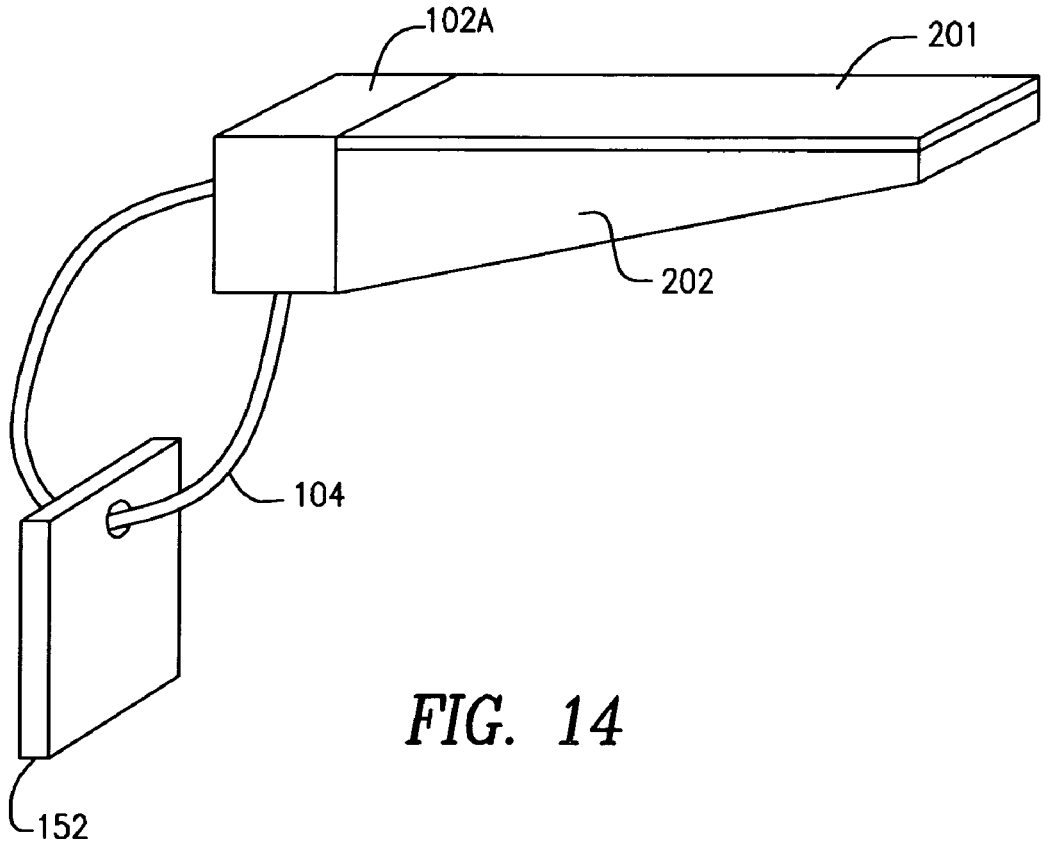
FIG. 14 illustrates an embodiment similar to that shown in FIGS. 13*a*-13*c*, but without the stop member.

Alternatively, the stop member 112 can be omitted if an end of the wire is fixed to the casing 102A, as shown in FIG. 14 or to some other portion of the indicia member 202.

Figure 15A:
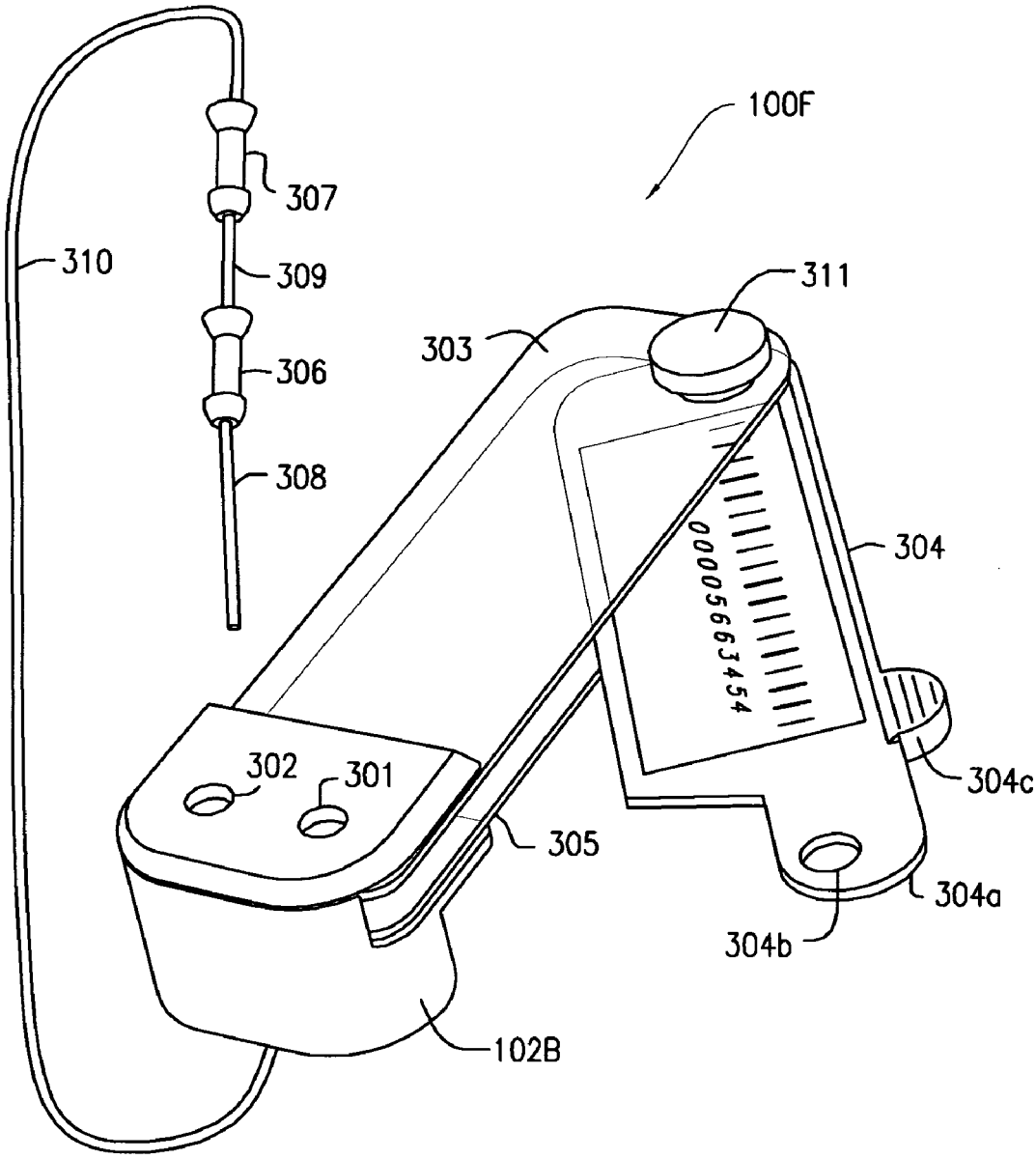
FIGS. 15*a*-15*d* illustrates a further embodiment of the security device of the present invention.

FIGS. 15*a*-15*d* illustrate an embodiment of the security device 100F of the present invention, which can be used to secure luggage or other items that would benefit from use of one or more security indicators. For example, the security device 100F can be used to lock the zipper loops of a piece of luggage during the check-in process at an airport. As shown in FIG. 15*a*, the security device 100F is provided with an indicia member comprising an indicia plate 304 sandwiched between two holding plates 303 and 305 extending from a casing 102B. The indicia plate 304 may rotate around a pivot 311 relative to the holding plates 303, 305 so as to slide into, or away from, the gap formed between the two holding plates 303, 305. Preferably, an edge of the indicia plate 304 is provided with a small protrusion 304*c* to help in pulling the indicia plate 304 out of the gap and away from the two holding plates 303, 305. It is noted that the plate 304 may rotate clockwise or counter clockwise about the pivot 311.

Two or more heads 306, 307 are provided on a wire 310, and one end of the wire 310 is fixed to the bottom of the casing 102B. It is noted that any number of heads may be used without departing from the spirit and scope of the present invention. Correspondingly, two or more receptacles are provided in the casing for receiving the two heads 306, 307 respectively, with the entry apertures 301, 302 formed on an upper surface of the casing 102B. Thus, respective security features of the security device 100F of this embodiment can be activated at different points in a securing process. More specifically, after head 306 is used, head 307 can be ready for use by cutting the wire portion 309 between the two heads.

Figure 15B:
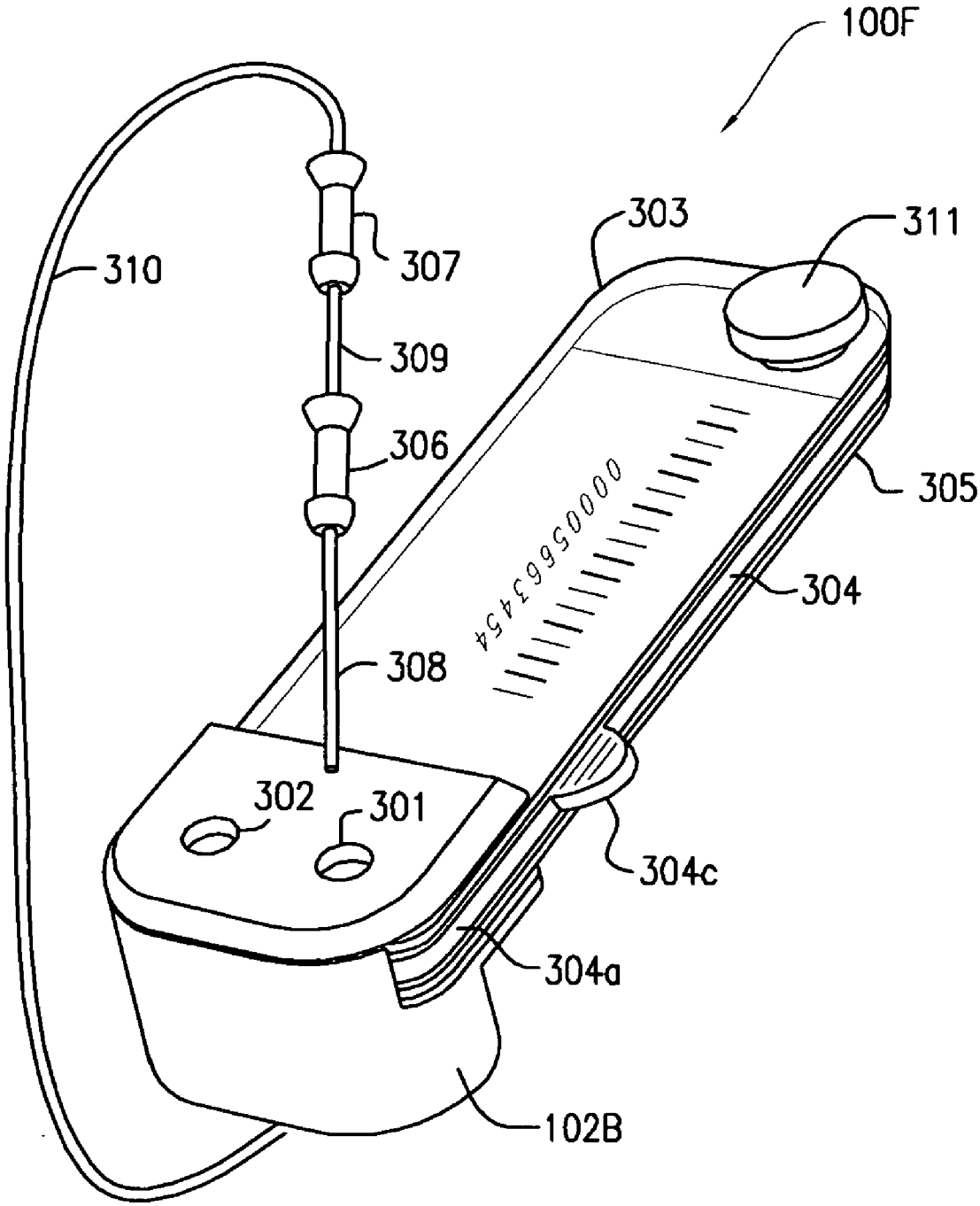

A web or tab 304*a* extends from the front end of the indicia plate 304, and a hole 304*b* is provided through the web 304*a*. When the indicia plate 304 moves into the gap between the holding plates 303, 305 as shown in FIG. 15*b*, and the hole 304*b* is aligned with the entry aperture 301, the heads 306 may be inserted through the aperture 301, and through the hole 304*b* such that the indicia plate 304 may be secured in its sandwiched position between the two holding plates 303 and 305. As noted above the plate 304 may rotate in either direction. Thus, the hole 304*b* may be aligned with either aperture 301 or 302 if desired.

Figure 15C:
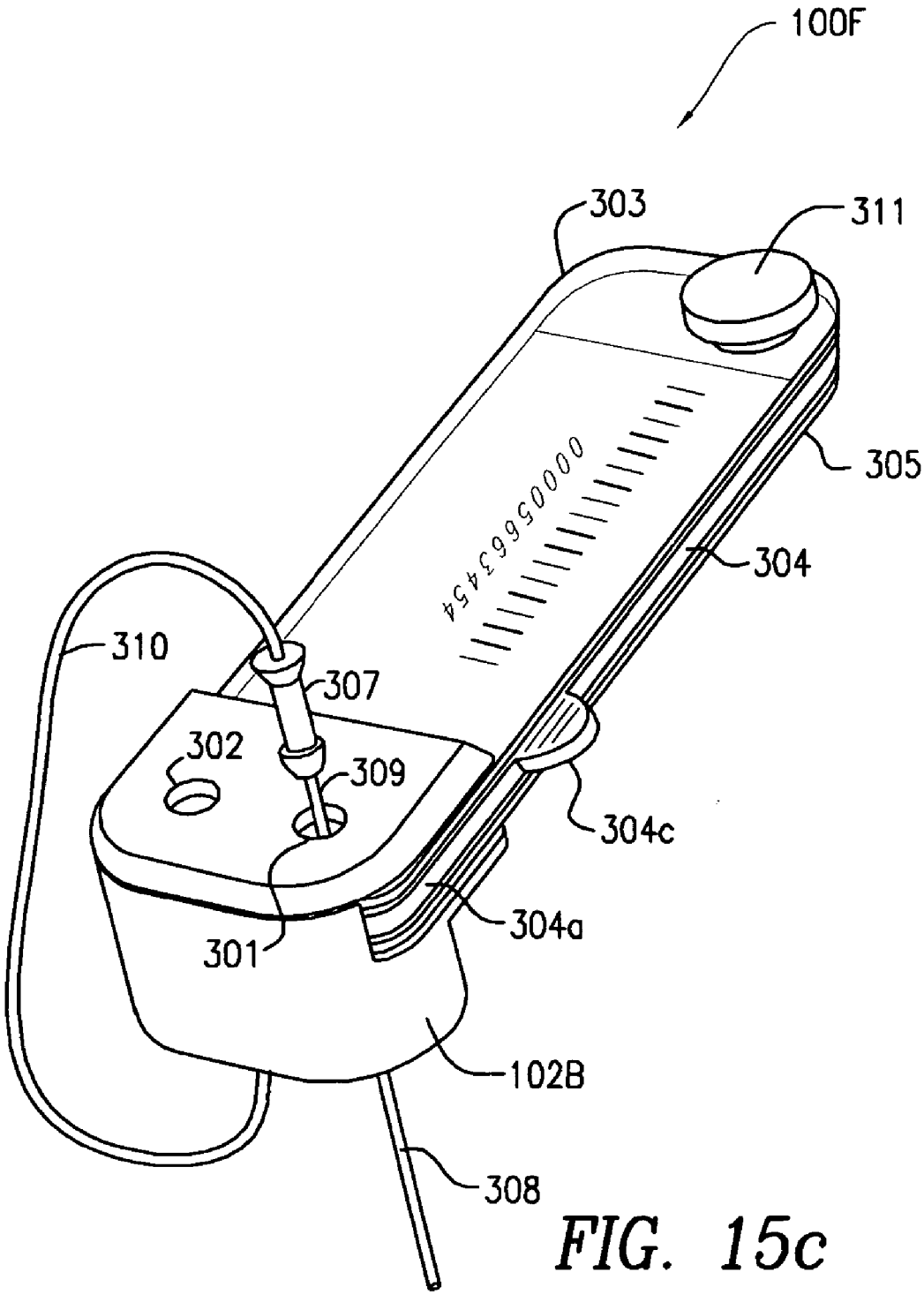
Figure 15D:
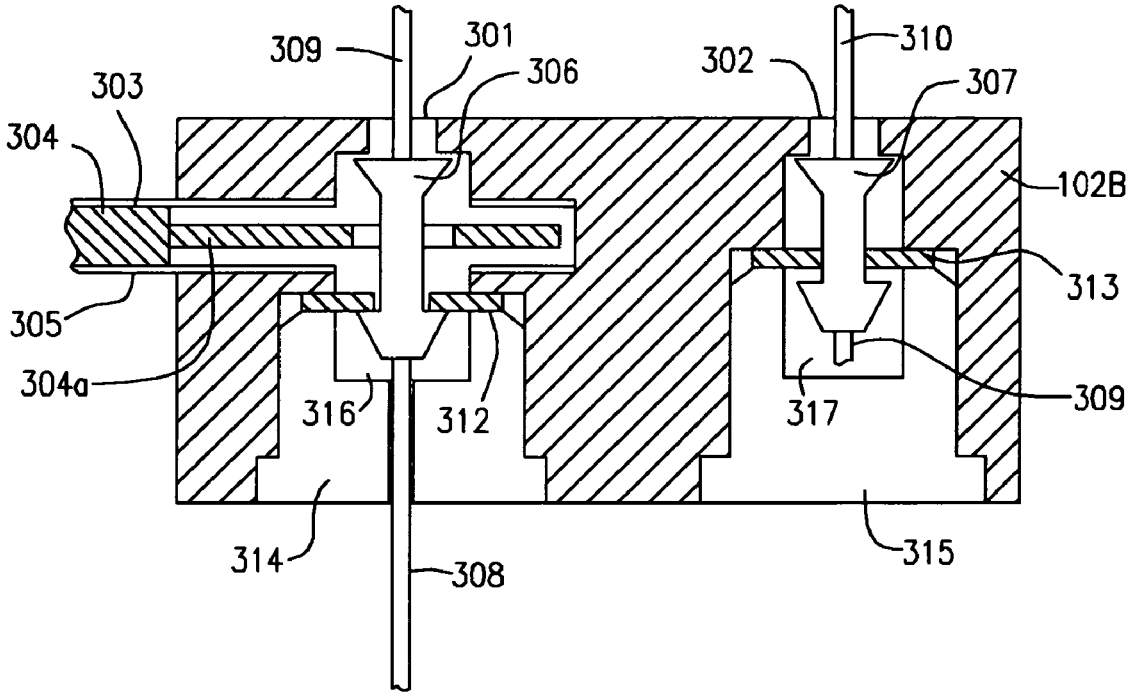

Preferably, web 304*a* has a thickness less than other part of indicia plate 304 so that web 304*a* can easily move into the casing 102B without obstruction, as most clearly shown in FIG. 15*d*.

Indicia plate 304 can bear an airline tag issued during the check-in process. Preferably, the airline tag is a small, detachable bar coded tag bearing an identification number (or other indicia), which is initially attached to the larger baggage tag that is issued during the check-in process. Alternatively, the holding plates 303 or 305 can be used to bear other information. For example, it can be used by the custom officer to apply a tag indicating that the baggage has been checked. It is understood that the indicia plate 304 can be used for bearing any indicia such as a passenger's signature, a tag, bar code, a serial number, etc., on both upper and lower surfaces of plate 304.

The top holding plate 303 and bottom holding plate 305 are preferably transparent so that the tag or other information applied on the indicia plate 304 can be easily read. The indicia plate 304, however, is preferably non-transparent.

An extension wire 308 may be provided at the forward portion of the head 306 so as to assist in pulling the head 306 into the casing 102B by pulling the extension 308 through the aperture 301, as most clearly shown in FIGS. 15*c*-15*d*. Extension wire 308 is preferably flexible.

FIG. 15*d* illustrates that the heads 306, 307 are kept in the casing 102B in a similar way as in the previous embodiments. More specifically, the forward portion of the head 306 is retained by the split ring 312 in the space 316 formed by the cover 314 so that the head 306 cannot leave the casing 102B but can slightly move inside the casing 102B. In a similarly way, the forward portion of the head 307 is retained by the split ring 313 in the space 317 formed by the cover 315. It is noted that cover 314 is formed with a through hole to allow the extension 308 to pass there through, while there is no requirement for such through hole in cover 315.

Spaces 316, 317 can be of any shape, as long as they are large enough to allow the forward portions of the heads 306, 307 to move inside the casing 102B. Preferably, as shown in FIG. 15*d*, space 317 also provides room to accommodate a stud of the wire portion 309 remaining after it has been cut. Device 100F can also be modified by replacing body 102B with any of the other bodies discussed herein, such as body 102C, body 102E or body 102F.

Here is an example how the security device 100F is used as a luggage lock at an airport. After curb side checking or counter checking, and once a large bar coded airline identification tag is issued and attached to the handle of the suitcase, a small (preferably detachable) bar coded tag that comes with the large tag is the one the passenger places on the upper surface of the indicia plate 304 because the lower surface of the indicia plate 304 has already been signed, or has any other personal identification mark the passenger has already made. Then the indicia plate 304 is inserted between the holding plates 303, 305 and locked by inserting the head 306 into the casing 102B through the aperture 301.

The suitcase with the head 306 in the casing 102B goes through a conveyer belt for TSA inspection. If the inspection agent decides to open the lock to inspect the suitcase, the connection wire 309 is cut. After the inspection, the agent inserts the second head 307 through the loops of the zipper, then finally into the aperture 302 such that it is locked in the casing 102B. The agent normally places the TSA identification tag for checked luggage onto the larger airline issued luggage bar coded identification tag after the inspection.

The two heads 306, 307 can be used for different checking purposes or at different checking stages. For example, they can be activated at different points in the customs process. The two heads 306, 307 can be different in color so that they can be easily identified for insertion into apertures 301 and 302 of corresponding color. Alternatively, the heads 306, 307 may be of different diameter or different shape to facilitate proper matching with corresponding apertures 301, 302. As illustrated in this embodiment, they can be different in length so as to avoid being misused with each other. Similarly, they can be of different diameter, or shape.

Figure 16:
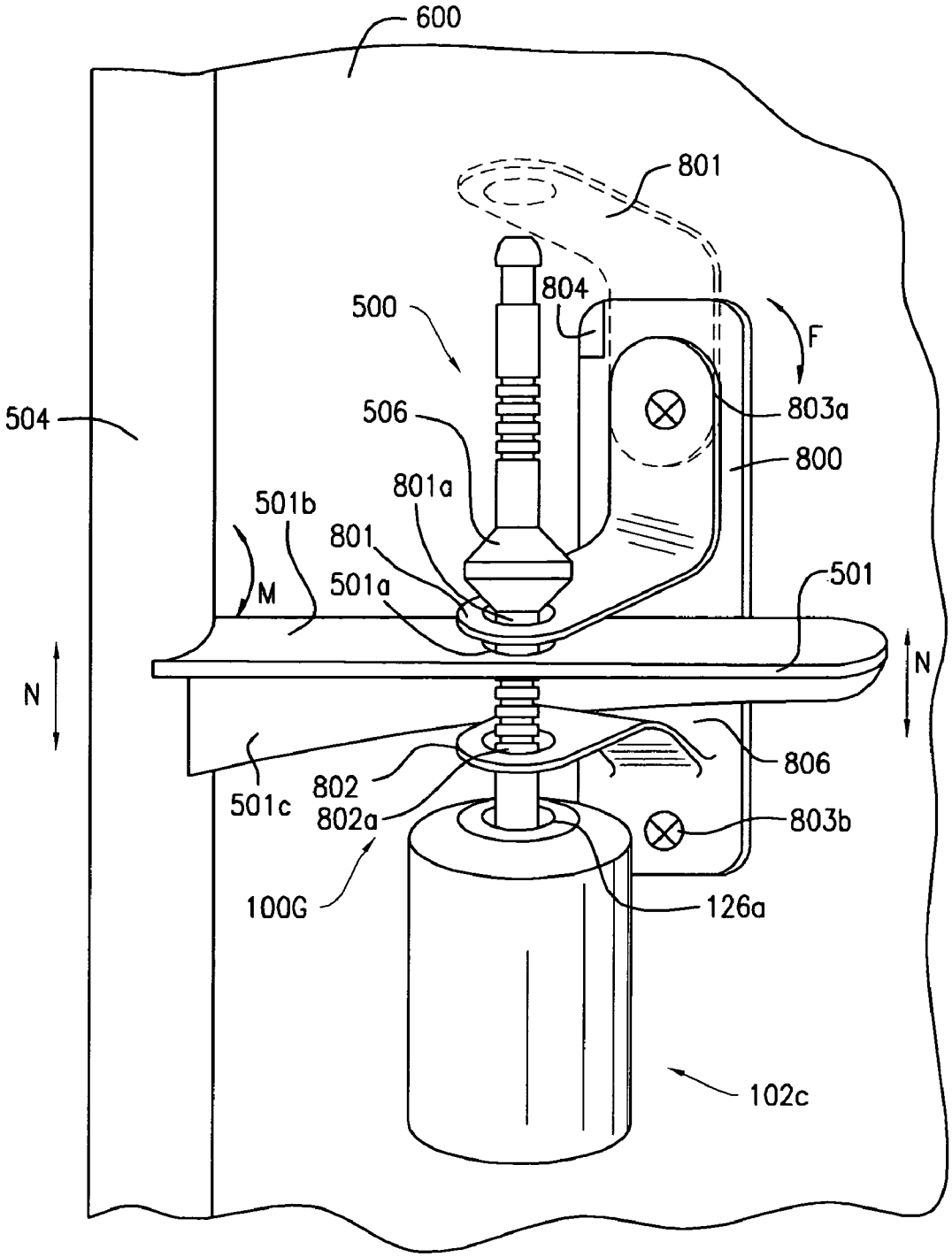
FIG. 16 illustrates a further embodiment of the security device of the present invention.
Figure 16A:
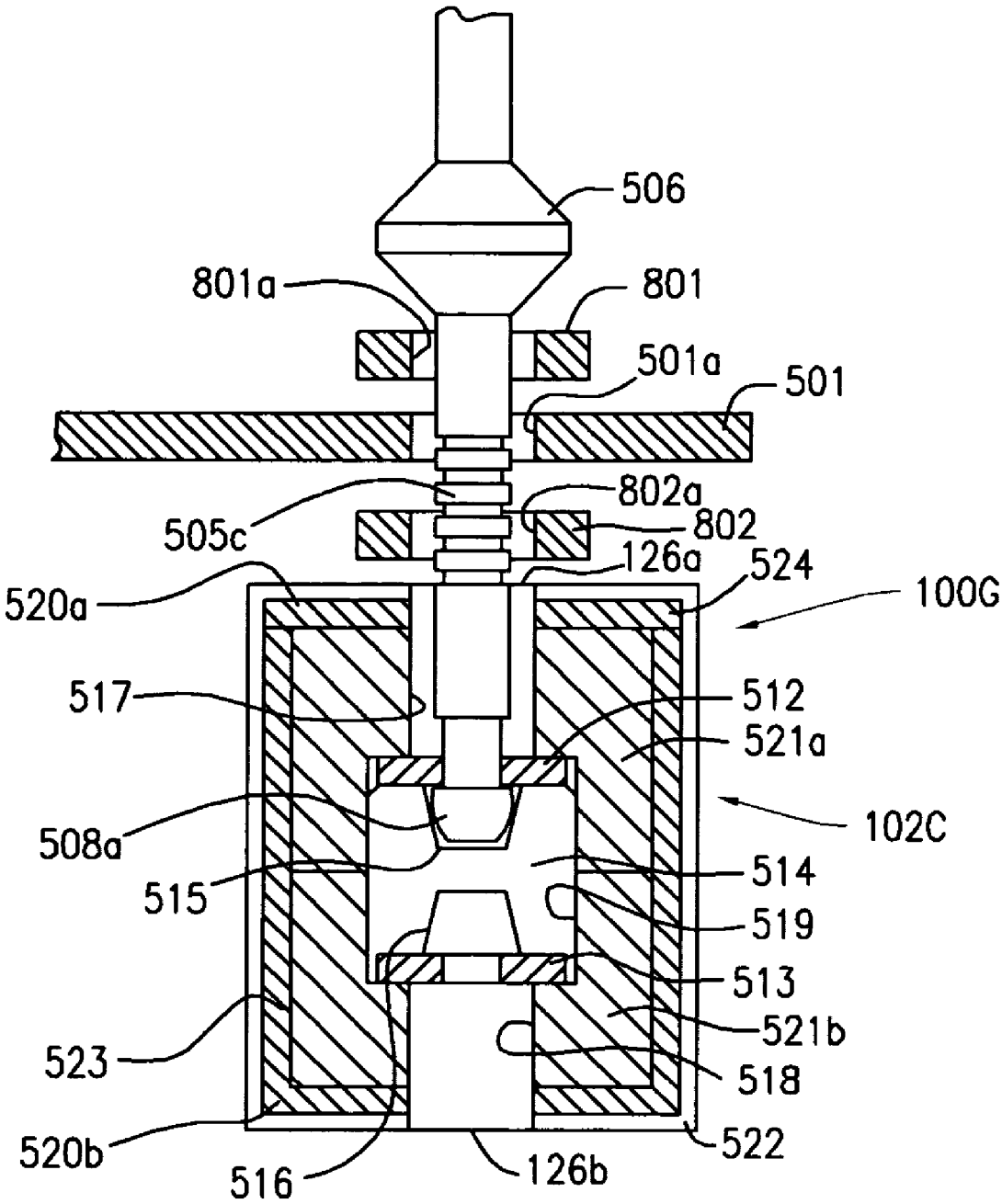
FIG. 16*a* is a sectional view showing the embodiment of FIG. 16.

FIGS. 16 and 16*a* illustrate an embodiment of the security device 10G. This embodiment is typically applicable in the process of inspecting a container at a port, a warehouse, factory or any location. As shown in FIG. 16, the security device 100G is operable to lock together a locking arm 501 and two locking plates 801, 802.

More specifically, through proper locking mechanism (not shown), a door 600 of the container is locked by a locking bar 504 which is rotatable and movable as shown in arrows M and N when the locking arm 501 is not in the locking position as shown in FIG. 16. The locking arm 501 is connected to the locking bar 504, e.g., by a special hinge (not shown) so that the locking arm 501 and the locking bar 504 are able to rotate and move as an integral part when required, as shown in arrows M and N respectively, relative to the door 600. The locking arm 501 may comprise a plate portion 501*b* extending in a horizontal plane, and a web portion 501*c* extending in a vertical plane. The web portion 501*c* supports the plate portion 501*b* so as to strengthen the locking arm 501.

Two locking plates 801, 802 are connected to a base plate 800, which is fixed to the door 600 through a pair of bolts or pins 803*a*, 803*b*. The upper locking plate 801 is connected to the base plate 800 through the upper pin 803*a*, and is rotatable around the upper pin 803*a* as shown by the arrow F. A block 804 is provided on the base plate 800 to stop the upper locking plate 801 at an upper position as shown in dash lines. The lower locking plate 802 is fixed to the base plate 800 by, e.g., welding, or can be formed together with the base plate 800 in the molding process.

FIG. 16 illustrates the security device 100G in its working position. First, the locking arm 501 is rotated toward the door 600, and is then placed at the space 806 formed between the lower locking plate 802 and the base plate 800. Thus, the web portion 501*c* is kept between the lower locking plate 802 and the base plate 800, preventing the locking arm 501 from moving away from the base plate 800. Then, the upper locking plate 801 is rotated around the upper pin 803 and lowered from its upper position as shown in dash lines to a lower position, resting above the locking arm 501 as shown in FIG. 16. At this position, the locking arm 501 is prevented from moving up, and therefore cannot leave the space 806 formed between the lower locking plate 802 and the base plate 800.

The locking plates 801, 802 and the locking arm 501 are formed with an aperture 801*a*, 802*a*, 501*a*, respectively. In the working position as shown in FIG. 16, the apertures 801*a*, 501*a*, 802*a* are aligned vertically, and a head member 500 of the security device 100G (as explained in more detail below) passes through the apertures 801*a*, 501*a*, 802*a* and enters the casing 126*a*, thereby locking together the locking arm 501 and the locking plates 801, 802. Thus, the locking bar 504 is prevented from movement, and locks the door 600 in place.

Figure 18A:
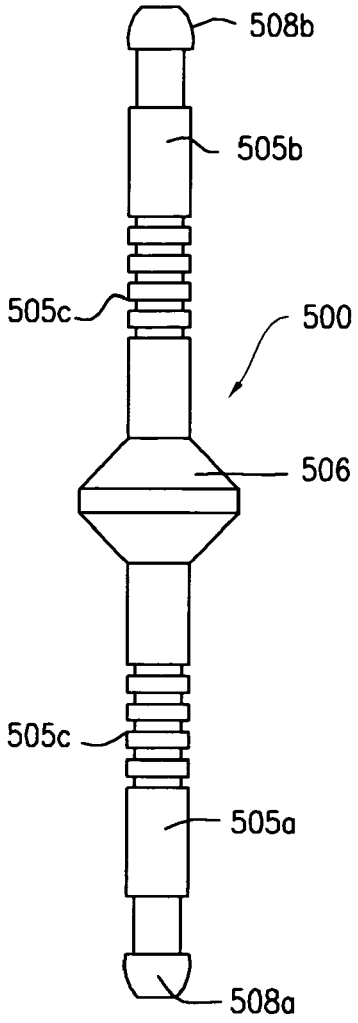
FIGS. 18*a*-18*c* illustrate different designs of the head member used in the embodiment shown in FIGS. 16 and 17.

The security device 100G of this embodiment comprises the head member 500 and a casing 102C. As shown in FIG. 16, the casing 102C is of generally cylindrical shape. However, it shall be understood that the specific shape of the casing 102C is not essential to the present invention. The head member 500, as best shown in FIG. 18*a*, has two beveled heads 508*a*, 508*b* and a bulging stop member 506 in between. The stop member 506 is connected to the two beveled heads 508*a*, 508*b* through two shafts 505*a*, 505*b* respectively. Dents 505*c* are formed on the shafts 505*a*, 505*b*, respectively, to facilitate cutting.

The diameter of the stop member 506 is substantially larger than that of the beveled heads 508*a*, 508*b* so that the heads 508*a*, 508*b* can easily pass through all the apertures 801*a*, 501*a*, 802*a* and apertures 126*a*, 126*b* (see FIG. 16*a*) of the casing 102C, respectively, while the stop member 506 cannot pass through the aperture 801*a* of the upper locking plate 801, whereby keeping the locking plates 801, 802 and the locking arm 501 between the stop member 506 and the casing 102C.

To release the locking, the shaft 505*a* of the head member 500 beneath the bulging member 506 (see FIG. 18*a*) is cut, and the casing 102C is removed from below. Then, the upper locking plate 801 is rotated to its upper position as shown in dash lines. The locking arm 501 is lifted to leave the space 806, and then rotated away from the base plate 800. Thus, the locking bar 504 is unlocked.

As shown in FIG. 16*a*, the casing 102C is formed with a generally cylindrical cavity 519, with two opposite passages 517, 518 extending from the cavity 519 to an upper surface 520*a* and bottom surface 520*b* respectively. This forms two oppositely directed apertures 126*a*, 126*b* on the two surfaces 520*a*, 520*b*. A core member 514 is accommodated in said cavity 519 to form an upper volume 515 and a lower volume 516 in the cavity 519, which are separated by the core member 514. The two passages 517 and 518 lead to the two volumes 515, 516, respectively. The core member 514 further holds two split rings 512, 513 inside the upper volume 515 and the lower volume 516, respectively, preventing them from axial movement (i.e., in the vertical direction in FIG. 16*a*).

The casing 102C is capable of accepting two heads 508*a*, 508*b* of the head member 500 shown in FIG. 18*a*. A first head 508*a* can be accepted in the upper volume 515 through the aperture 126*a* on the upper surface 520*a* (as shown in FIGS. 16 and 16*a*). A second head 508*b* can be accepted in the lower volume 516 from the aperture 126*b* on the lower surface 520*b*. Thus, the security device 100G can be used twice. The first use is to provide a lock to secure and the second time to provide a lock after a single inspection. In each instance the casing 102C, which bears the indicia, remains the same.

To facilitate manufacturing and assembling, the casing 102C in FIG. 16*a* is preferably made as two separate parts 521*a*, 521*b*. After the split rings 512, 513 and the core member 514 are assembled inside the cavity 519, the two parts 521*a* and 521*b* are enclosed in a housing formed by an external casing 523 and a casing cover 524 that are made of metal or metal alloy. Then, the assembled external casing 523, the casing cover 524, the parts 521*a*, 521*b*, core member 514 and the split rings 512, 513 are held in an plastic enclosure 522 as shown in FIG. 16*a* to form an integrated casing 102C. The housing formed by the external casing 523 and the casing cover 524 results a tougher casing 102C to meet high resistant requirements. The plastic enclosure 522 functions as a protective cover as well as a bonding agent to hold together component parts of the casing 102C, preferably all of which are made of metal alloy. Conveniently, indicia can be inscribed on the plastic enclosure 522. Alternatively, the two parts 521*a*, 521*b* can be assembled together by welding, joints, etc.

Alternatively, the two parts 521*a*, 521*b*, together with the split rings 512, 513 and the core member 514 assembled in the cavity 519, are enclosed in the plastic enclosure 522, and the external casing 523 and the casing cover 524 are omitted.

Figure 17:
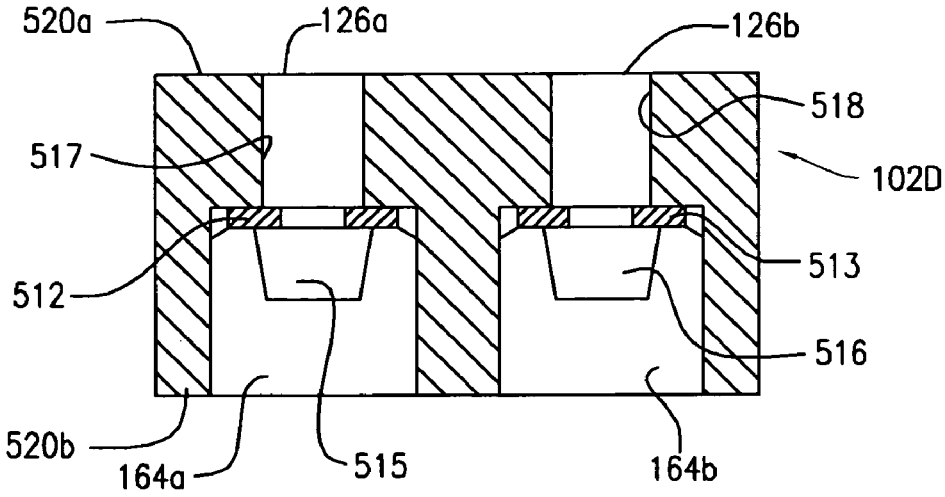
FIG. 17 shows an alternative embodiment of the casing shown in FIG. 16*a;*

Alternatively, the two volumes 515, 516 can be formed side by side in the casing 102D, as shown in FIG. 17. The apertures 126*a*, 126*b* are both formed on the upper surface 520*a*, and two covers 164*a*, 164*b* are inserted from the lower surface 520*b* to form the volumes 515, 516 and to hold the split rings 512, 513 inside the volumes 515, 516, respectively. With the two volumes 515, 516, the casing 102D can be used to accept two head members 500 for replacement.

Figure 17A:
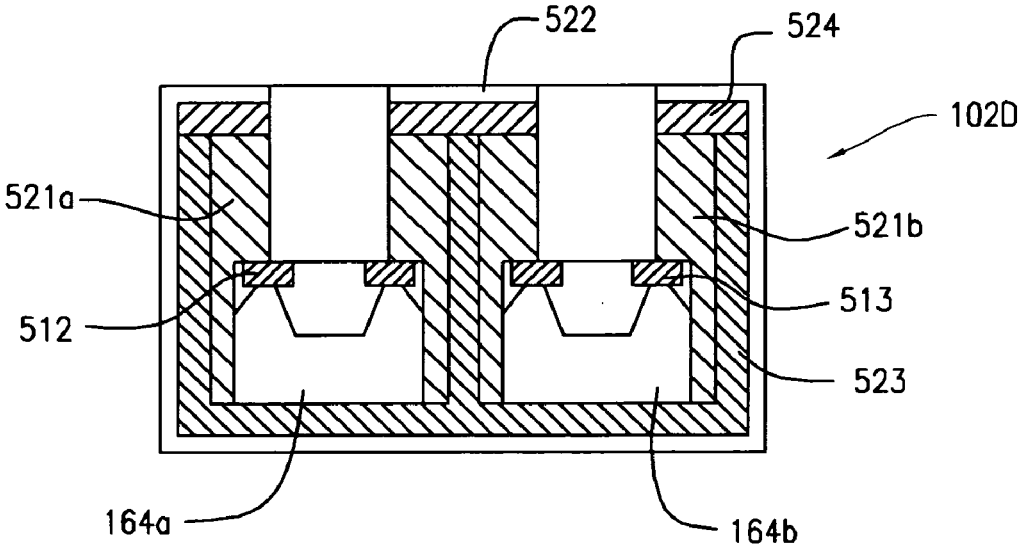

Alternatively, as shown in FIG. 17*a*, the casing 102D may also be made of two separate parts 521*a*, 521*b*. After the two separate parts 521*a*, 521*b* are assembled with the split rings 512, 513 and the covers 164*a*, 164*b*, they are accommodated in two housings formed by an external casing 523 and a casing cover 524 that are made of metal or metal alloy. Then, the assembled external casing 523, the casing cover 524, the parts 521*a*, 521*b*, and the split rings 512, 513 are held in an plastic enclosure 522 as shown in FIG. 17*a* to form an integrated casing 102D.

Like the embodiment shown in FIG. 16*a*, the casing 102D may further comprises a plastic enclosure, and the covers 164*a*, 164*b* may be eliminated. The split rings 512, 513 can be inserted through an opening cap provided on the plastic enclosure.

The head member 500 can also be made with two consecutive heads 508*a*, 508*b* and two stop members 506*a*, 506*b*. The stop member 506*a* is connected to the head 508*b* by a connection wire 509. Before using the second head 508*b*, however, two cuts have to be made, one at the shaft 505*a* (to release the locking), and one at the connection wire 509.

Figure 18B:
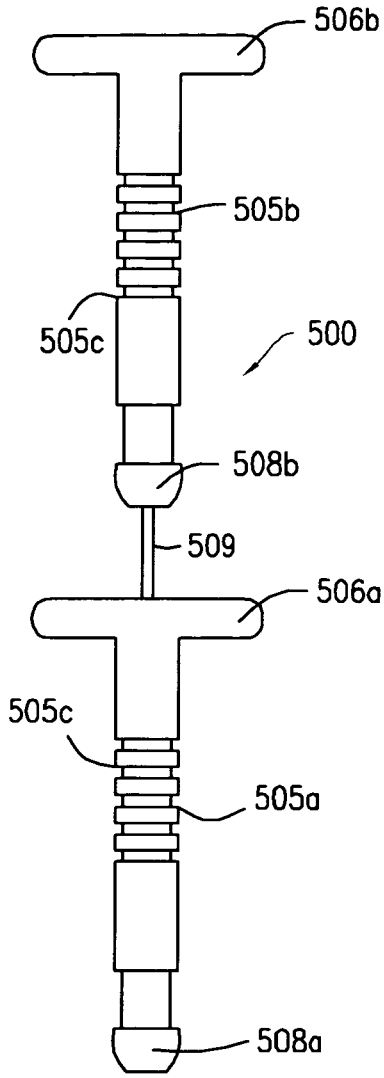
Figure 18C:
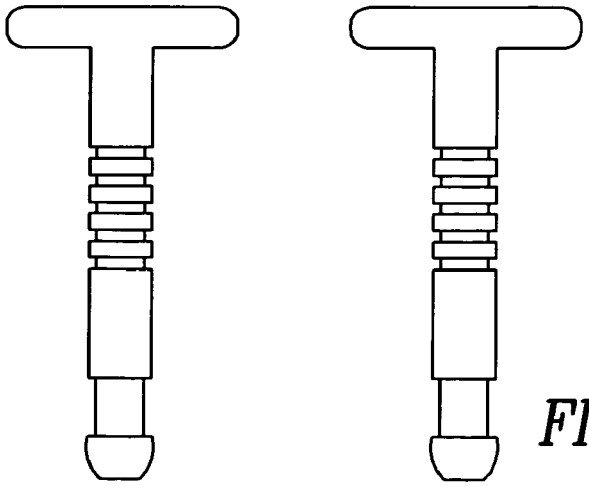

Alternatively, the head member 500 can also be made as two separate elements as shown in FIG. 18*c*.

The stop member 506 can have a shape of a bulge as shown in FIG. 18*a*, or of a flat plate as in FIGS. 18*b* and 18*c*, or have any other proper shape, as long as its diameter is large enough to prevent it from passing through the aperture 801*a* of the locking plate 801 (see FIG. 16). More generally, the stop member 506 shall be large enough to lock at least one of the locking plates 801, 802 and the locking arm 501 between the stop member 506 and the casing 102C or 102D after the head 508*a* or 508*b* is inserted into the casing 102C or 102D.

While the preferred embodiments have been described and illustrated it will be understood that changes in details and obvious undisclosed variations might be made without departing from the spirit and principle of the invention. For example, one of the blocking plates 801, 802 in FIG. 16 can be omitted, and the locking arm 501 is locked to only one locking plate 801 or 802 by the security device 10G. Therefore the scope of the invention is not to be construed as limited to the preferred embodiment.

Figure 19A:
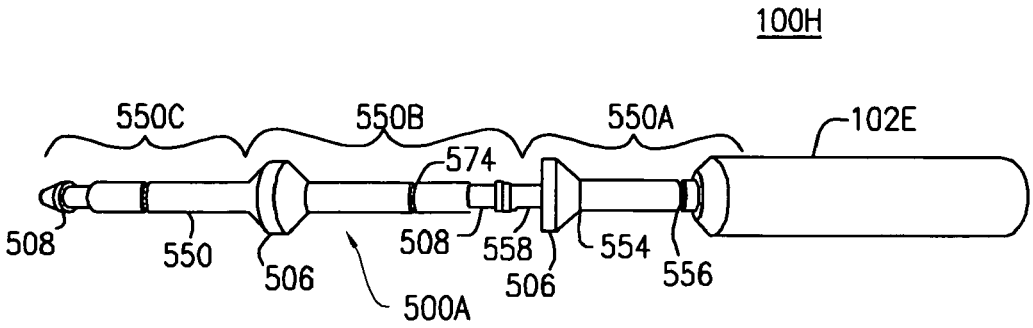
FIGS. 19*a-c* illustrate a security device in accordance with one or more further aspects of the present invention.
Figure 19B:
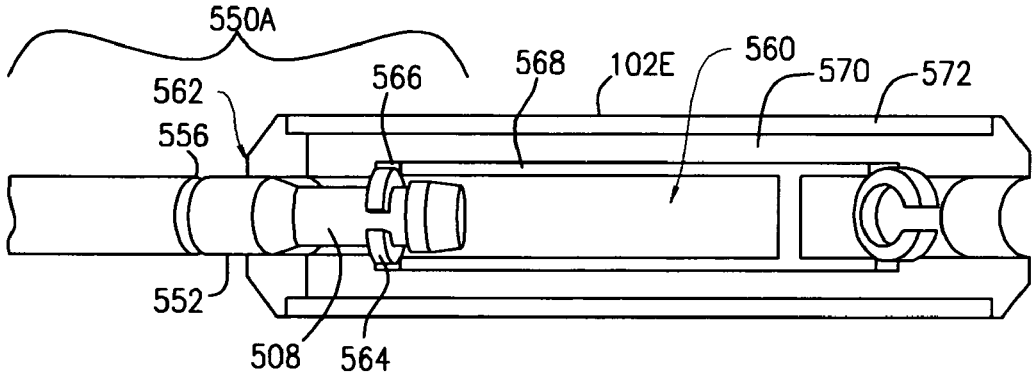
Figure 19C:
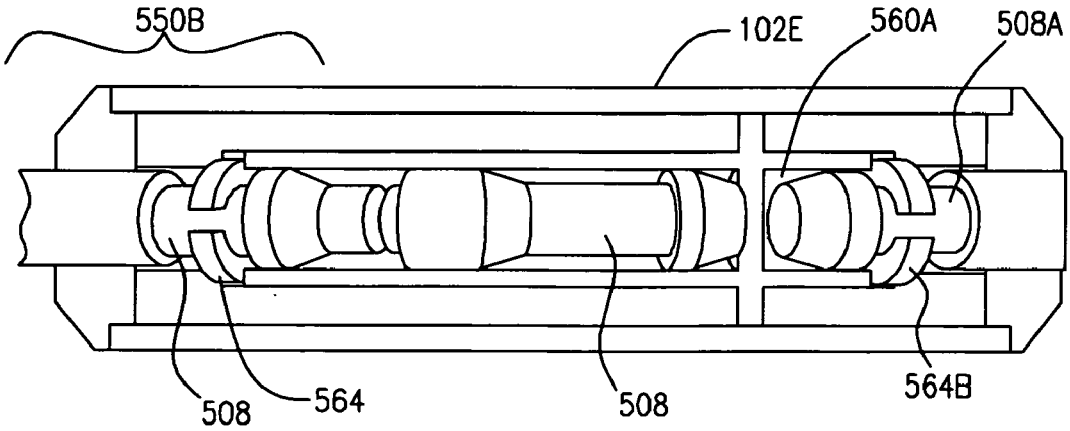

FIGS. 19*a*-19*c* illustrate an alternative embodiment of a security device 100H, which is preferably utilized for locking a container, such as the container illustrated in FIG. 16. The security device 100H includes a shaft 500A and a body 102E. The shaft 500A includes a plurality of sections 550A, 550B, 550C, etc. Each section 550 preferably includes a first end 552 coupled to a head 508 and a second end 554 coupled to a stop member 506. Each of the sections 550 also preferably includes at least one breaking portion 556 disposed between the head 508 and the stop member 506 and a further breaking portion 558 disposed on an opposite side of the stop member 506 from the head 508.

As best seen in FIG. 19*b*, the body 102E is preferably of substantially similar construction as the bodies of the previous embodiments discussed hereinabove except that a length of the cavity 560 is sufficient to receive more than one of the heads 508 in axial alignment (see FIG. 19*c*). As with other embodiments of the present invention, the cavity 560 is preferably operable to receive the head 508 in an insertion direction and lock the head 508 such that the head 508 may not be withdrawn opposite to the insertion direction without destroying the apparatus 100H. In this regard, the body 102E includes an input aperture 562 operable to receive the head 508 into the cavity 560 and a split ring 564 in axial alignment with the input aperture 562. The cavity 560 preferably includes a channel 566 that is operable to engage an outer edge of the split ring 564 such that the split ring 564 is prevented from moving in an axial direction. The channel 566 may be formed by placing one or more sleeves 568 into the cavity 560 to create appropriate differences in diameter proximate to the split ring 564.

In a preferred embodiment, the body 102E includes a metal or metal alloy core 570 defining at least a portion of the cavity 560 and a plastic outer cover 572 surrounding the core 570.

In use, the shaft 500A is preferably used to urge a first one of the heads 508 into the input aperture 562 in order to lock same within the cavity 560. It is understood that the shaft 500A of the first section 550A may be used to lock a container of the type illustrated in FIG. 16. Thereafter, it may be desirable to unlock the container (such as for inspection or the like) without destroying the apparatus 100H. In this regard, the shaft 500 may be broken at the breaking portion 556 of the first section 550A, thereby separating the head 508 of the first section 550A from the remainder of the shaft 500A. Next, the stop member 506 of the first section 550A may be separated from the shaft 500A by breaking at the breaking portion 558. This exposes the head 508 of the second section 550B for insertion into the body 102E.

As best seen in FIG. 19*c*, the head 508 of the second section 550B may be inserted into the input aperture 562, urge the head 508 of the first section 550A into the cavity 560, and lock within the split ring 564. While the length of the cavity 560 is sufficient to receive two heads 508 as illustrated in FIG. 19*c*, it is noted that the length may be longer if desired to receive further heads 508 without departing from the spirit and scope of the present invention. Thus, the shaft 500A may be broken at breaking portion 574 of the second section 550B and the head 508 of the third section 550C may be used to urge the head 508 of the second section 550B into the cavity 560 such that the head 508 of the third section 550C may be locked within the body 102E. Those skilled in the art will appreciate that shafts of many different configurations may be employed having a number of heads, stopping members, breaking portions, etc. to achieve any number of locking actions and unlocking actions so long as the cavity 560 is capable of receiving an appropriate number of heads 508.

It is intended that the number and extent of locking and unlocking of the security device 102E may correspond to the methods as discussed above with respect to screening and verifying documents, luggage, and the like. In this regard, it is noted that the shaft 500A may include indicia on any number of the sections 550, it being preferred that such indicia is located on the stop members 506. Such indicia may include a serial number or the like that is associated with a serial number on the body 102E. Thus, it may readily be understood by skilled artisans that the security device 102E may be used for locking and/or inspection verification procedures, such as those discussed in one or more of the previous embodiments.

As best seen in FIG. 19*c*, the body 102E may include a further cavity 560A and split ring 564B to receive a further head 508A. This further cavity 560A is preferably of a construction substantially similar to any of the preceding cavities of this or other embodiments of the present invention. It is noted, however, that this further cavity 560A need not be employed.

Figure 20A:
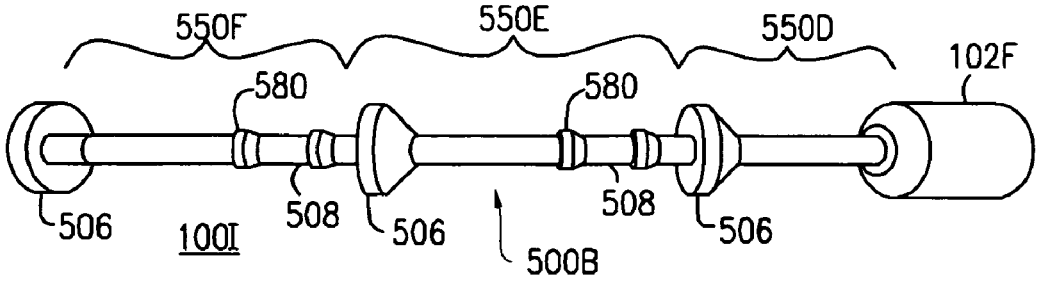
FIGS. 20*a-c* illustrate a security device in accordance with one or more further aspects of the present invention.
Figure 20B:
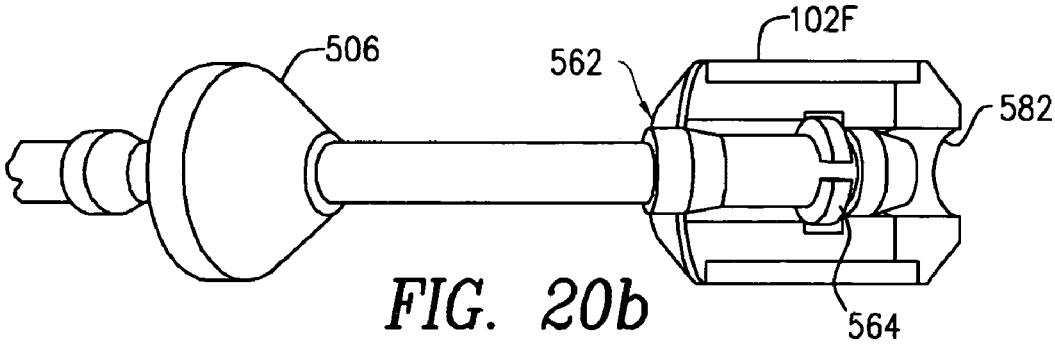
Figure 20C:
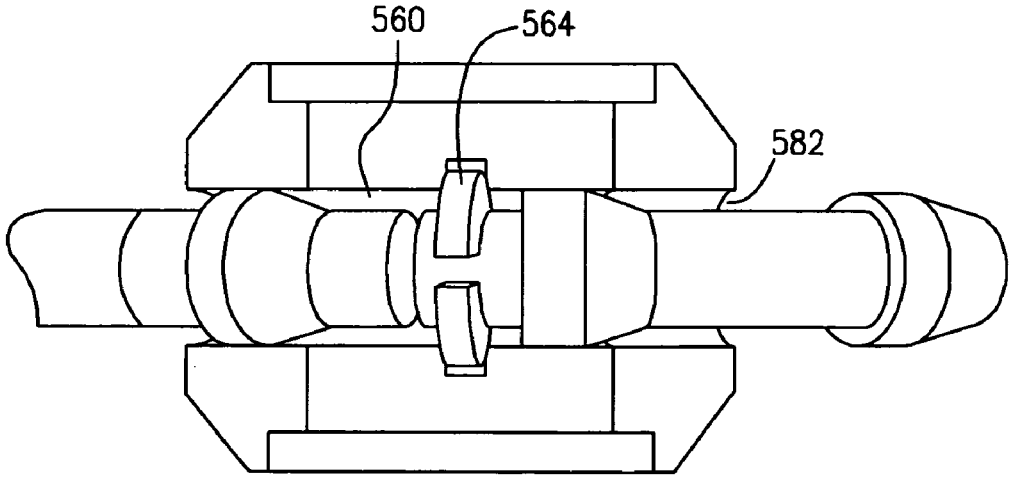

Reference is now made to FIGS. 20*a*-20*c*, which illustrate one or more further embodiments of the present invention, including a security device 100I, which is preferably utilized for locking a container, such as the container illustrated in FIG. 16. In this embodiment, the shaft 500B is substantially similar to the shaft 500A of FIG. 19*a*, except that one or more of the respective sections 550D, 550E, 550F, etc. preferably include a supporting element 580 that is operable to stabilize the shaft 500B within the input aperture 562 of the body 102F. As with the security device 100H of FIGS. 19*a*-19*c*, the security device 100I of FIGS. 20*a*-20*c* may be used to lock and unlock a container by breaking the shaft 500B in order to expose subsequent heads 508 for insertion into the body 102F. Unlike the body 102E of the security device 100H, however, the body 102F of the security device 100I includes an output aperture 582 that is axially aligned with the input aperture 562 and the split ring 564 and in communication with the cavity 560 such that the head 508 entering the body 102F urges one or more further heads 508 through the cavity 560 and out the output aperture 582. It is also noted that the head 508 could enter through 582 and exit through 562, bearing in mind that further heads 508 must enter and exit in the same direction as the first head 508 when using the same 102F. Advantageously, any number of heads 508 may pass through the body 102F and, therefore, the body 102F may be reused any number of times. Although the length of the cavity 560 of the security device 100I is illustrated as accommodating only one head 508 at a time, it is contemplated that the length may be of any extent without departing from the spirit and scope of the present invention.

It is noted that the shaft 500B may include indicia on any number of the sections 550, it being preferred that such indicia is located on the stop members 506. Such indicia may include a serial number or the like that is associated with a serial number on the body 102F. Also individual head 508 similar to that described in FIG. 18C may be used.

Figure 21:
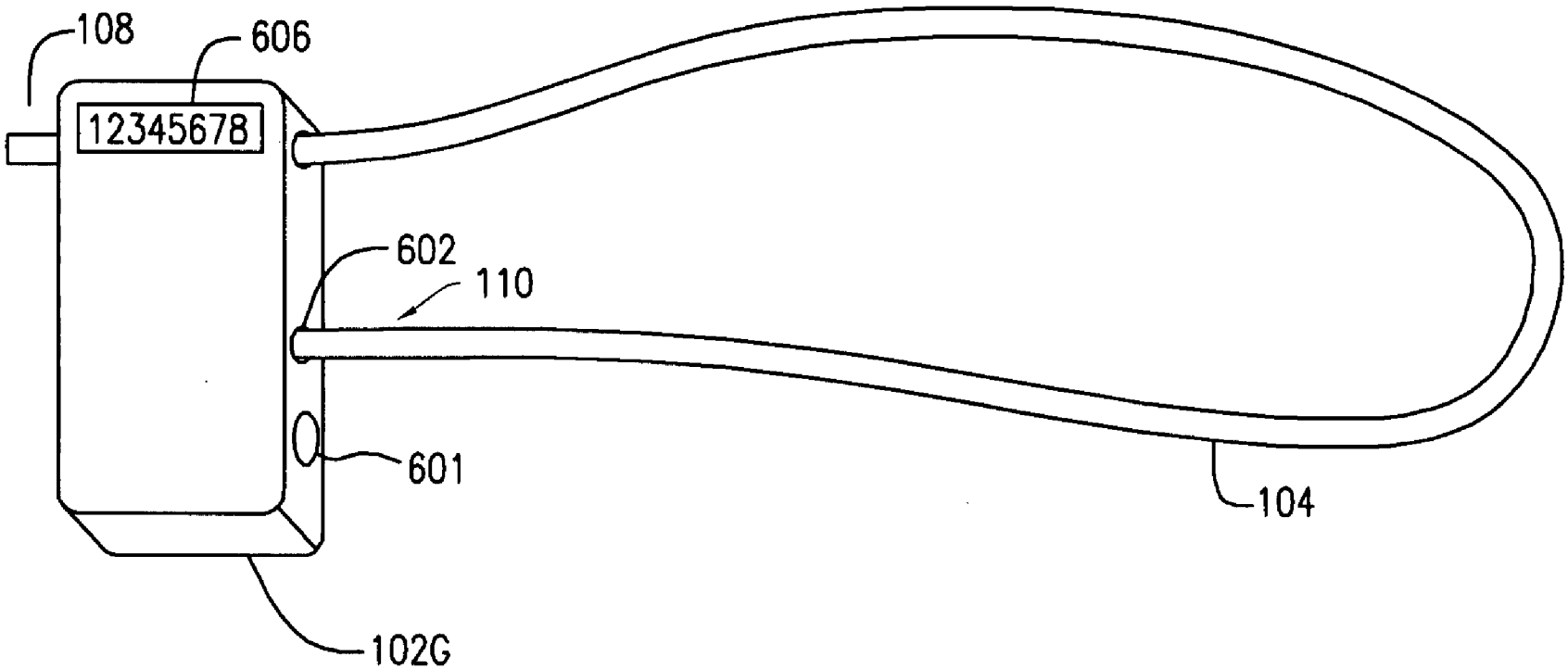
FIG. 21 is a perspective view of an alternative embodiment of a security device in accordance with one or more further aspects of the present invention.

Reference is now made to FIG. 21, which is a perspective view of an alternative embodiment of a security device in accordance with one or more further aspects of the present invention. The security device includes a wire 104 and a body 102G. The wire 104 has a proximal end 108 and a distal end 110, where the proximal end 108 is fixedly coupled to the body 102G of the security device. The body 102G includes at least 2 apertures 601, 602, where each aperture is operable to receive and lock the distal end 110 of the wire 104 at different times such that when the wire 104 is locked in one of the apertures 601, 602 it can not be removed without destroying the apparatus.

Preferably, the distal end 110 of the wire 104 is operable to pass through one or more apertures of an object (not shown) and lock in each of the apertures 601, 602 of the body 102G to lock the security device to the object at different times. Once the distal end 110 of the wire 104 is locked in one of the apertures 601, 602 it preferably cannot be removed. In a preferred embodiment, the body 102G includes a pawl (not shown) operatively disposed with respect to the aperture such that it may engage the distal and 110 of the wire 104, permit the wire 104 to slide through the aperture in an insertion direction, and prevent the wire 104 from sliding out of the aperture in a removal direction. Preferably, each aperture 601, 602 includes a pawl disposed in this fashion.

Preferably, the wire 104 is operable to be broken such that the distal end 110 thereof is retained in one of the apertures (e.g., aperture 602) and a new distal end of the wire 104 may be inserted in the other of the apertures (e.g., aperture 601) to permit a subsequent use of the security device. Notably, the new distal end may be taken from an opposite end of the wire 104 from the proximal end 108. Alternatively, the new distal end of the wire 104 may be taken opposite from the distal end 110 that is retained in the aperture 602. Either way, the new distal end may be passed through one or more apertures of the object and locked within the aperture 601 to lock the security device to the object a subsequent time. As the body 102G may include any number of apertures, the security device may be re-used numerous times. Preferably, the body 102G includes indicia 606 that is maintained no matter how many times the security device in re-used.

It is noted that the wire 104 may be formed from metal, metal alloy, plastic, or combinations thereof, and the wire 104 may exhibit rigidity, flexibility, and differing lengths depending on the application. Further, the body 102G may be formed of metal, metal alloy, plastic, or combinations thereof.

Preferably, the security device of FIG. 21 may incorporate any number of the design details discussed hereinabove with respect to other embodiments of the invention as will be readily apparent to one of ordinary skill in the art having considered this detailed description.

Figure 22:
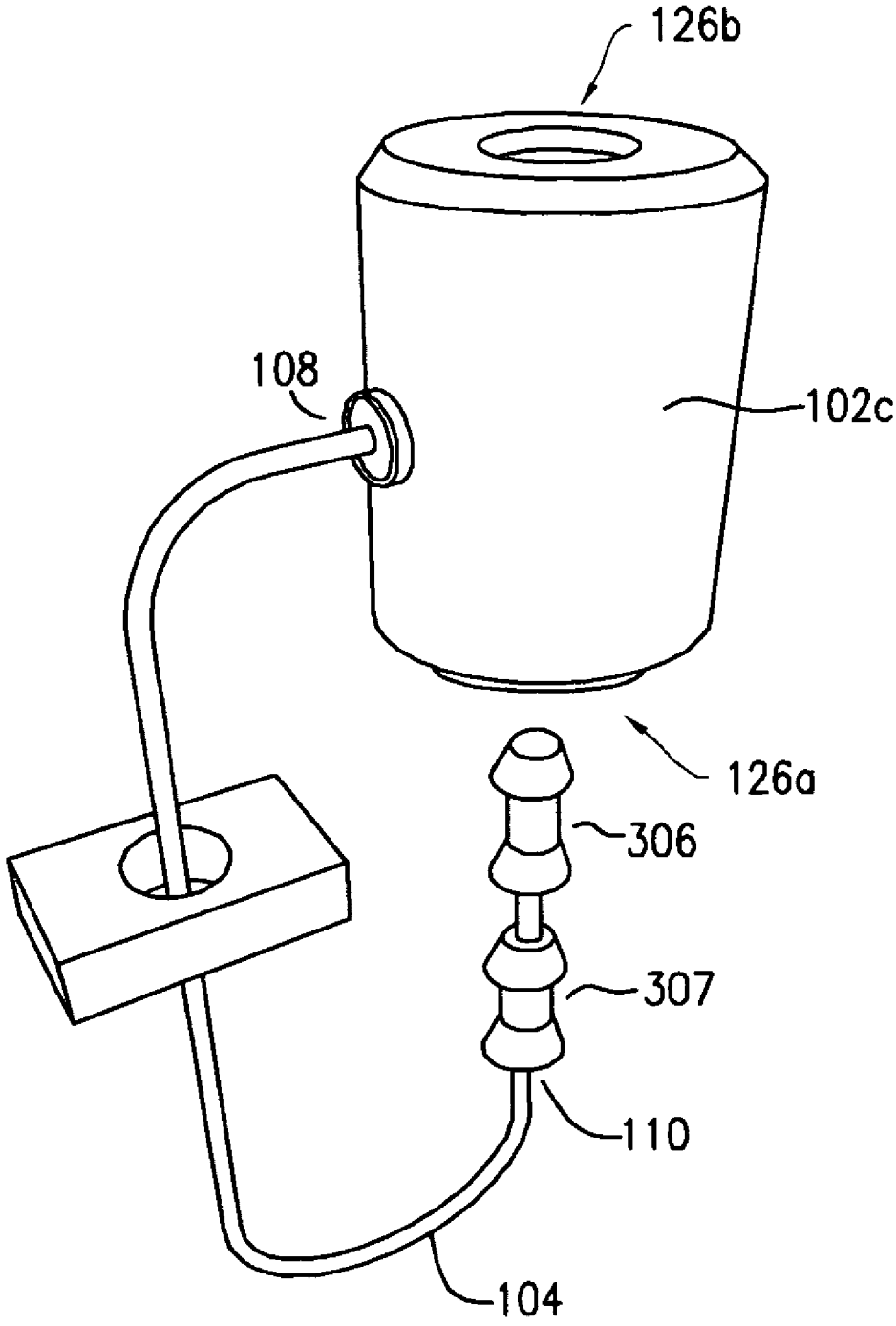
FIG. 22 is a perspective view of a further alternative embodiment of a security device in accordance with one or more further aspects of the present invention.

Reference in now made to FIG. 22, which is a perspective view of an alternative embodiment of a security device in accordance with one or more further aspects of the present invention. It is noted that the security device combines elements found in FIGS. 1, 15*a*, and 16 described hereinabove. In particular, the security device includes two or more heads 306, 307 coupled to one another in series, a wire 104 having a first end 110 coupled to a last of the heads 307 and a second end 108 fixedly coupled to a body 102*c*. The body 102*c* includes two or more cavities 126*a*, 126*b* for receiving and locking respective ones of the heads 306, 307. The heads 306, 307 and wire 104 are preferably operable to pass through one or more apertures of an object (not shown). The first head 306 is preferably operable to lock in a first of the cavities 126*a* such that the body 102*c* retains the wire 104 in engagement with the aperture of the object and maintains the security device locked to the object.

The second head 307 (and any subsequent heads) are preferably operable to separate from the first head 306 such that the wire 104 and the body 102*c* may be unlocked from the object. Thereafter, the second head 307 may be inserted in the other cavity 126*b* to permit a subsequent use of the security device. It is noted that third, fourth, etc. heads may be further separated and inserted into further cavities to permit further subsequent uses of the security device.

Preferably, the security device of FIG. 22 may incorporate any number of the design details discussed hereinabove with respect to other embodiments of the invention as will be readily apparent to one of ordinary skill in the art having considered this detailed description.

Figure 23:
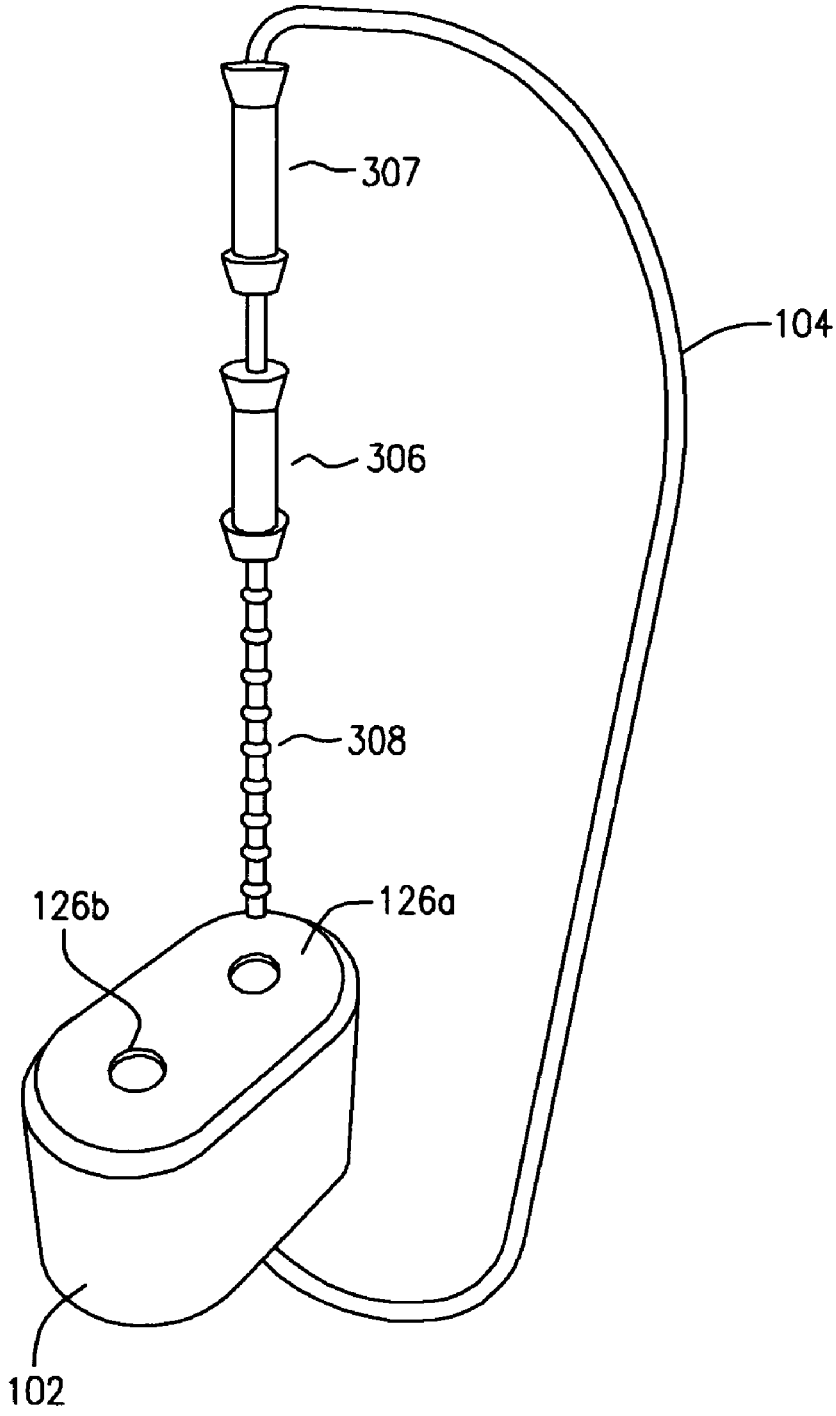
FIG. 23 is a perspective view of a still further alternative embodiment of a security device in accordance with one or more further aspects of the present invention.

Reference is now made to FIG. 23, which is a perspective view of a security device in accordance with one or more further aspects of the present invention. In many ways, the security device of FIG. 23 is substantially similar to that of FIG. 22 except that the plurality of apertures 126*a*, 126*b* are laterally aligned as opposed to axially aligned. Further, the first head 306 is coupled to an extension wire 104 so as to assist in pulling the head 306 into the body 102 by pulling the extension wire 308 through the aperture 126*a*. In all other ways, the security device of FIG. 23 preferably includes the features and alternative design characteristics discussed hereinabove.

Preferably, the security device of FIG. 23 may incorporate any number of the design details discussed hereinabove with respect to other embodiments of the invention as will be readily apparent to one of ordinary skill in the art having considered this detailed description.

Figure 24:
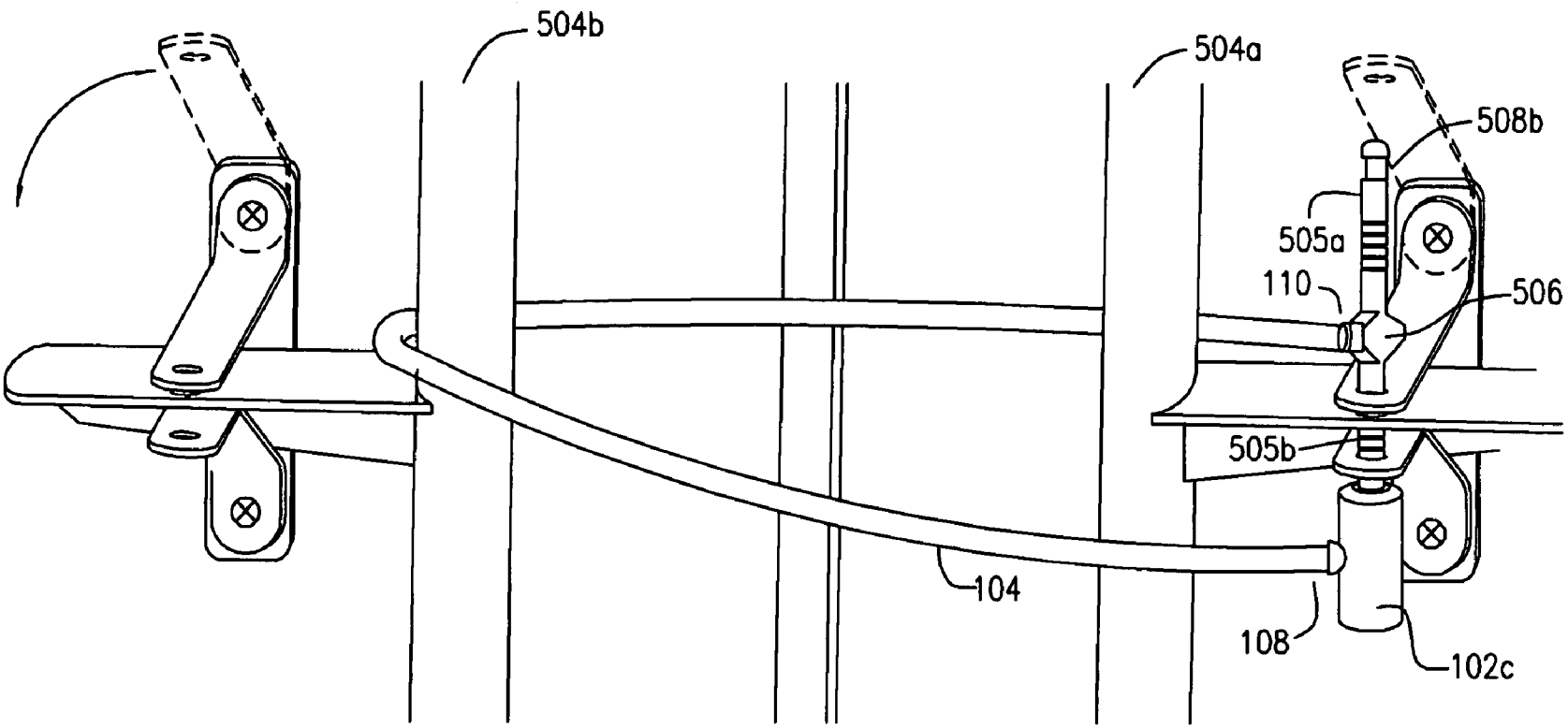
FIG. 24 is a perspective view of a still further alternative embodiment of a security device in accordance with one or more further aspects of the present invention.

Reference is now made to FIG. 24, which is a perspective view of security device in use in accordance with one or more further aspects of the present invention. It is noted that the security device is substantially similar to the security device discussed hereinabove with respect to FIGS. 16, 16*a*, 17, 17*a*, 18*a-c*, 19*a-c* and 20*a-c*. In other words, the security device of FIG. 24 may include one or more of the aspects discussed hereinabove with respect to those figures. The security device includes a shaft 505 (which may include shaft 505*a* and shaft 505*b*) and one or more heads 508 coupled to the shaft 505. As shown, the security device includes two heads 508*a*, 508*b*, with head 508*a* being locked within the body 102*c*. The security device also includes a wire 104 having a first end 110 coupled to the shaft 505 (e.g., via the stop member 506) and a second end 108 fixedly coupled to the body 102*c*. In an alternative embodiment, the first end 110 of the wire 104 may be coupled to a different part of the shaft 505 or an intermediate member (not shown). The body 102*c* includes one or more cavities as discussed hereinabove for receiving and locking the head 508*a* (or further heads if numerous cavities are employed).

In addition to the ability of the shaft/body to lock to an object, such as a container described hereinabove, the wire 104 is preferably operable to pass through other portions of the object in order to achieve further security goals. In particular, the wire 104 may engage one or more door locking bars 504*a*, 504*b* to prevent the doors from being opened when the security device is locked to the container.

Preferably, the wire 104 may be formed from metal, metal alloy, plastic, or combinations thereof. The wire 104 may also exhibit rigidity, flexibility, and/or differing lengths in order to achieve specific security goals. Preferably, the security device of FIG. 24 may incorporate any number of the design details discussed hereinabove with respect to other embodiments of the invention as will be readily apparent to one of ordinary skill in the art having considered this detailed description.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus for locking to an object, the apparatus comprising:

at least one elongate member having (i) at least two shafts, each having a first end and a second end coupled together at a stop member; and (ii) a head disposed at each of the first ends of the shafts, each head being oppositely directed from one another; and a body having at least two apertures, each aperture for receiving and locking a respective one of the heads at different times such that, when locked, the heads cannot be removed without destroying the apparatus, wherein:

the heads are non-deformable and include a maximum diameter that is not larger than a diameter of the apertures of the body, the elongate member is operable to pass through one or more apertures of the object, a first of the heads is operable to lock in a first of the apertures of the body such that the body retains the elongate member in engagement with the one or more apertures of the object and maintains the apparatus locked to the object, the first head is detachable from its respective shaft after insertion into the first aperture of the body such that a second of the heads is operable to lock in a second of the apertures of the body for a second opportunity to lock the apparatus locked to the object, and at least one of: (i) the elongate member includes a plurality of separate shafts, each having one of the heads at the first end thereof and one of the stop members at the second end thereof; and (ii) the elongate member includes a plurality of shafts, each having one of the heads at the first end thereof and one of the stop members at the second end thereof, and each being coupled together.

2. The apparatus of claim 1, wherein:

the first and second heads are disposed at first ends of two of the shafts and the two shafts are coupled together at a first stop member; and a distal end of the second head is coupled to the stop member of another of the shafts.

3. The apparatus of claim 2, wherein at least one of:

each of the heads define a respective insertion direction;

the other shaft includes a third head at an end opposite to the stop member thereof and the third head is oriented such that the insertion direction thereof is coaxial in the same direction with the second head; and at least the first and second heads are oriented such that the insertion directions thereof are coaxial in opposite directions.

4. The apparatus of claim 1, wherein at least one of:

each of the apertures of the body define a respective receiving direction for the heads;

at least two of the apertures of the body are oriented such that they share a common receiving direction;

at least two of the apertures of the body are oriented such that they share a common receiving direction and are laterally offset from one another; and at least two of the apertures of the body are oriented such that their receiving directions are coaxially aligned in opposite directions.

5. The apparatus of claim 4, wherein at least one of the apertures of the body is disposed at opposing ends of the body.

6. The apparatus of claim 1, wherein:

one or more of the apertures of the body may each include an input to receive one of the heads into a cavity and a split ring in axial alignment with the input, the cavity including a channel operable to engage an outer edge of the split ring such that the split ring is prevented from moving in an axial direction; and one or more of the heads may each include a first end having a beveled forward portion and a second end, the split ring being operable to permit the beveled forward portion of the head to pass therethrough in an insertion direction and the split ring being operable to prevent the beveled forward portion from being removed after the beveled forward portion passes therethrough.

7. The apparatus of claim 6, wherein one or more of the apertures of the body may each further include a stop surface oppositely disposed within the cavity from the input and spaced away from the split ring such that the stop member limits axial movement of the head into the cavity and the split ring limits axial movement of the head out of the cavity, but the head is permitted some degree of axial movement.

8. The apparatus of claim 1, wherein the at least two apertures of the body are oppositely directed.

9. An apparatus for locking to an object, the apparatus comprising:

at least one elongate member having (i) at least two shafts, each having a first end and a second end coupled together at a stop member; and (ii) a head disposed at each of the first ends of the shafts, each head being oppositely directed from one another; and a body having at least two apertures, each aperture for receiving and locking a respective one of the heads at different times such that, when locked, the heads cannot be removed without destroying the apparatus, wherein:

the heads are non-deformable and include a maximum diameter that is not larger than a diameter of the apertures of the body, the elongate member is operable to pass through one or more apertures of the object, a first of the heads is operable to lock in a first of the apertures of the body such that the body retains the elongate member in engagement with the one or more apertures of the object and maintains the apparatus locked to the object, the first head is detachable from its respective shaft after insertion into the first aperture of the body such that a second of the heads is operable to lock in a second of the apertures of the body for a second opportunity to lock the apparatus locked to the object, the first and second heads are disposed at first ends of two of the shafts and the two shafts are coupled together at a first stop member, and a distal end of the second head is coupled to the stop member of another of the shafts.

10. An apparatus for locking to an object, the apparatus comprising:

at least one elongate member having (i) at least two shafts, each having a first end and a second end coupled together at a stop member; and (ii) a head disposed at each of the first ends of the shafts, each head being oppositely directed from one another; and a body having at least two apertures, each aperture for receiving and locking a respective one of the heads at different times such that, when locked, the heads cannot be removed without destroying the apparatus, wherein:

the heads are non-deformable and include a maximum diameter that is not larger than a diameter of the apertures of the body, the elongate member is operable to pass through one or more apertures of the object, a first of the heads is operable to lock in a first of the apertures of the body such that the body retains the elongate member in engagement with the one or more apertures of the object and maintains the apparatus locked to the object, the first head is detachable from its respective shaft after insertion into the first aperture of the body such that a second of the heads is operable to lock in a second of the apertures of the body for a second opportunity to lock the apparatus locked to the object, one or more of the apertures of the body may each include an input to receive one of the heads into a cavity and a split ring in axial alignment with the input, the cavity including a channel operable to engage an outer edge of the split ring such that the split ring is prevented from moving in an axial direction, and one or more of the heads may each include a first end having a beveled forward portion and a second end, the split ring being operable to permit the beveled forward portion of the head to pass therethrough in an insertion direction and the split ring being operable to prevent the beveled forward portion from being removed after the beveled forward portion passes therethrough.

* * * * *